US012098463B2

(12) United States Patent
Chen et al.

(10) Patent No.: US 12,098,463 B2
(45) Date of Patent: Sep. 24, 2024

(54) METHOD FOR MANUFACTURING AMORPHOUS MULTIELEMENT METAL OXIDE HYDROXIDE FILM

(71) Applicant: NATIONAL SUN YAT-SEN UNIVERSITY, Kaohsiung (TW)

(72) Inventors: Chun-Hu Chen, Kaohsiung (TW); Ren-Huai Jhang, Kaohsiung (TW); Chang-Ying Yang, Kaohsiung (TW)

(73) Assignee: NATIONAL SUN YAT-SEN UNIVERSITY, Kaohsiung (TW)

( * ) Notice: Subject to any disclaimer, the term of this patent is extended or adjusted under 35 U.S.C. 154(b) by 374 days.

(21) Appl. No.: 17/583,714

(22) Filed: Jan. 25, 2022

(65) Prior Publication Data

US 2022/0145467 A1 May 12, 2022

Related U.S. Application Data

(63) Continuation-in-part of application No. 16/409,619, filed on May 10, 2019, now abandoned.

(30) Foreign Application Priority Data

Dec. 25, 2018 (TW) ..... 107147031

(51) Int. Cl.
*C23C 18/12* (2006.01)

(52) U.S. Cl.
CPC ..... *C23C 18/1216* (2013.01); *C23C 18/1295* (2013.01)

(58) Field of Classification Search
CPC ..... C23C 18/1216; C23C 18/1295
See application file for complete search history.

(56) References Cited

U.S. PATENT DOCUMENTS 5,861,218 A 1/1999 Sakurai et al.
2010/0167037 A1 7/2010 Lee et al.
(Continued)

FOREIGN PATENT DOCUMENTS

WO WO2014026720 2/2014

OTHER PUBLICATIONS

Jiang et al ("Influence of preparation temperature and acid treatment on the catalytic activity of MnO2" Journal or Solid State Chemistry 272 (2019) 173-181 (Year: 2019).*
(Continued)

*Primary Examiner* — Nathan H Empie
(74) *Attorney, Agent, or Firm* — WPAT, PC

(57) ABSTRACT

A method for manufacturing an amorphous multielement metal oxide hydroxide film includes: A liquid mixture is formed by dissolving an oxidizing agent selected from a group consisting of potassium permanganate, potassium chromate, potassium dichromate and potassium ferrate, and a reducing agent in a solvent. The oxidizing agent forms an oxometallate anion having a first metal atom with a first valence number. The reducing agent forms a metal cation having a second metal atom with a third valence number. An amorphous multielement metal oxide hydroxide film is deposited on a substrate by soaking the substrate in the liquid mixture. The amorphous multielement metal oxide hydroxide film includes a multielement metal oxide hydroxide having the first metal atom with a second valence smaller than the first valence number and the second metal atom with a fourth valence number larger than the third valence number.

7 Claims, 43 Drawing Sheets

(56) References Cited

U.S. PATENT DOCUMENTS

| | | | |
|---|---|---|---|
| 2011/0197782 | A1 | 8/2011 | Wang et al. |
| 2012/0115047 | A1 | 5/2012 | Ma et al. |
| 2015/0020925 | A1 | 1/2015 | Bares et al. |
| 2015/0048280 | A1 | 2/2015 | Chen et al. |
| 2020/0199756 | A1* | 6/2020 | Chen ..... C23C 18/1216 |

OTHER PUBLICATIONS

Dong et al. "Selective Reduction-Oxidation Strategy to the Conductivity-Enhancing Ag-Decorated Co-Based 2D hydroxides as Efficient Electrocatalyst in Oxygen Evolution Reaction" ACS Sustainable Chem Eng 2018, 6, 13420-13426 (Year: 2018).*

Yeh et al. "Cobalt Iron Oxides Prepared by Acidic Redox-Assisted Precipitation: Characterization, Applications, and New Opportunities", 2021, pp. 52181-52192, Applied Materials & Interfaces.

Jhang et al "Redox-assisted multicomponent deposition of ultrathin amorphous metal oxides on arbitrary substrates: high durable cobalt manganese oxyhydroxide for efficient oxygen evolution" J. Mater. Chem. A., 2018, 6, 17915. (Year: 2018).

Yu, L. "Complex metal oxide-based electrode materials for electrochemical energy storage". Doctoral Thesis, Nanyang Technological University, Singapore (2016) (Year: 2016).

* cited by examiner

| Sample | Tafel slope (mV/dec) |
|---|---|
| Co:Mn= 1:3 | 64.0 |
| Co:Mn= 1:1 | 62.9 |
| Co:Mn= 3:1 | 62.0 |
| Co:Mn= 5:1 | 61.2 |
| Co:Mn= 7:1 | 60.9 |
| Co:Mn= 9:1 | 77.8 |

METHOD FOR MANUFACTURING AMORPHOUS MULTIELEMENT METAL OXIDE HYDROXIDE FILM

CROSS REFERENCE TO RELATED APPLICATIONS

This is a continuation-in-part application of U.S. patent application Ser. No. 16/409,619 filed on May 10, 2019, and claims the benefit of Taiwan application serial No. 107147031, filed on Dec. 25, 2018, the entire contents of which are incorporated herein by reference.

BACKGROUND OF THE INVENTION

1. Field of the Invention

The present invention generally relates to a method for manufacturing an amorphous multielement metal oxide hydroxide material and, more particularly, to a method for manufacturing an amorphous multielement metal oxide hydroxide film.

2. Description of the Related Art

Ultrathin multicomponent deposition (<10 nm) over large dimensions is of great interest to engineers and scientists, but it commonly suffers from island-like discontinuity and elemental segregation. Transition metal oxide thin films with uniform thickness and continuous coverage are shown to be essential in a wide range of modern devices and architectures, including flexible and wearable electronics.

Well-established chemical and physical depositions (e.g. chemical vapor deposition, evaporation, sputtering, atomic layer deposition, etc.) require a high standard of operation conditions (e.g. delicate chemicals, high vacuum/energy consumption, expensive instrumentation, etc.) but provide limited production scales. Solution processable deposition, due to its low-cost and easy operation, emerges to explore low temperature, massive-scale fabrication on substrates of low thermal-durability (plastics/soft materials) and complex 3D structures.

Many typical solution-processable depositions (e.g., drop-casting, sol-gel, spray/dip/spin coating, etc.) require pyrolysis to remove an organic residue and to promote film adhesion, however, they are not suitable for amorphous/metastable deposition and soft/flexible substrates. Electrodeposition may be considered as a substitute to avoid pyrolysis, but highly conductive substrates are generally needed. The drawbacks of pinhole formation, rapid deposition rates hindering ultrathin coatings, and inhomogeneous multi-element deposition due to varied deposition potentials for individual elements, also limit its control in active site formation and charge transport resistance for electrocatalysis.

Thin films of earth-abundant transition metal oxides with easy deposition are promising candidates to achieve efficient oxygen evolution reaction (OER) at a reasonable cost. Notably, studies have shown that amorphous transition metal oxides, including intermediate states present during electrocatalysis, possess greater activities than their crystalline forms.

As an example, US 2015/048280 A1 discloses dissolving potassium permanganate ($KMnO_4$) and cobalt sulfate ($CoSO_4 \cdot 7H_2O$) in water, followed by performing a redox reaction at a temperature of 200° C. and a pressure of 1554.9 kPa for a time period ranging from 8 to 24 hours to obtain crystalline cobalt manganese oxide hydroxide (CMOH) following the chemical equation (1):

$$Mn^{7+} + 3Co^{2+} \rightarrow Mn^{4+} + 3Co^{3+}. \quad \text{chemical equation (1)}$$

However, by the previously mentioned method, the obtained crystalline CMOH is in the form of particle. That is, an amorphous multielement metal oxide hydroxide film cannot be obtained. In light of this, it is necessary to provide a method for manufacturing an amorphous multielement metal oxide hydroxide film.

SUMMARY OF THE INVENTION

It is therefore an objective of the present invention to provide a method for manufacturing an amorphous multielement metal oxide hydroxide film to form the amorphous multielement metal oxide hydroxide film in a form of a film.

One embodiment of the present invention discloses the method for manufacturing the amorphous multielement metal oxide hydroxide film comprising steps of: In the step S1, a liquid mixture is formed by dissolving an oxidizing agent and a reducing agent in a solvent. The oxidizing agent is selected from a group consisting of potassium permanganate ($KMnO_4$), potassium chromate ($K_2CrO_4$), potassium dichromate ($K_2Cr_2O_7$) and potassium ferrate ($K_2FeO_4$). The oxidizing agent dissociates in the solvent, forming an oxometallate anion with a first metal atom. The first metal atom of the oxometallate anion has a first valence number. The reducing agent dissociates in the solvent, forming a metal cation having a second metal atom. The second metal atom of the metal cation has a third valence number. Then, in the step S2, an amorphous multielement metal oxide hydroxide film is deposited on a substrate by soaking the substrate in the liquid mixture. The amorphous multielement metal oxide hydroxide film includes a multielement metal oxide hydroxide having the first metal atom and the second metal atom. The first metal atom of the multielement metal oxide hydroxide has a second valence number smaller than the first valence number of the first metal atom of the oxometallate anion, while the second metal atom of the multielement metal oxide hydroxide has a fourth valence number larger than the third valence number of the second metal atom of the metal cation.

In preferred form shown, in the step S1, a molar ratio between the reducing agent and the oxidizing agent in the liquid mixture can ranges from 9-to-1 to 1-to-3.

In preferred form shown, in the step S1, an additive can be dissolved in the solvent, forming an ion with a third metal atom. The third metal atom of the ion has a fifth valence number. In the step S2, the multielement metal oxide hydroxide is a ternary metal oxide hydroxide. The third metal atom of the ternary metal oxide hydroxide has a sixth valence number equal to the fifth valence number of the third metal atom of the ion.

In preferred form shown, in the step S2, the amorphous multielement metal oxide hydroxide film can be deposited at a temperature ranging from 1° C. to 99° C. under an atmospheric environment.

In preferred form shown, in the step S2, the amorphous multielement metal oxide hydroxide film can be deposited at room temperature under standard atmospheric pressure.

In preferred form shown, in the step (S2), the substrate can be selected from a group consisting of silicon crystal, carbohydrate, glass, nickel foam, metal, metal oxide, organic matter, organic polymer, carbon material and glassy carbon electrode.

In preferred form shown, in the step (S1), the solvent can be deionized water having a resistivity of 18.2 MΩ-cm.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIGS. 2-10 are schematic diagrams (1) to (9) that illustrate a deposition procedure and characterization of $CMOH_{acetate}$; wherein:

FIG. 2 is a diagram of dipping a transparent FTO substrate into the aqueous reaction mixture of $Co(OAc)_2$ and $KMnO_4$;

FIG. 3 shows a diagram of aging FTO for 15 minutes (min.);

FIG. 4 shows a diagram of removing the FTO substrate after complete deposition (the darker contrast area), processes from FIGS. 2 to 4 are performed in sequence;

FIG. 5 shows a diagram of an SEM image;

FIG. 6 shows a diagram of AFM data of the coatings;

FIG. 7 shows a diagram of grazing-angle XRD patterns of thin and thick CMOH deposition by $Co(OAc)_2$ and $CoSO_4$;

FIG. 8 shows a diagram of an HR-TEM image of $CMOH_{acetate}$ foils;

FIG. 9 shows a diagram of $CMO_{acetate}$ after annealed at 500° C.; and

FIG. 10 shows a diagram of a TEM image of CMOH after 10,000 cycles of OER tests;

Figure 8:
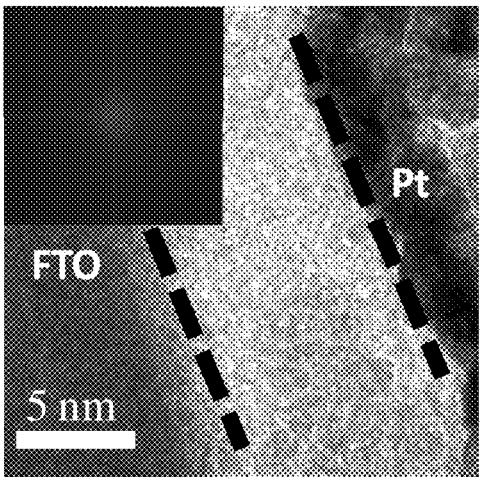
Figure 9:
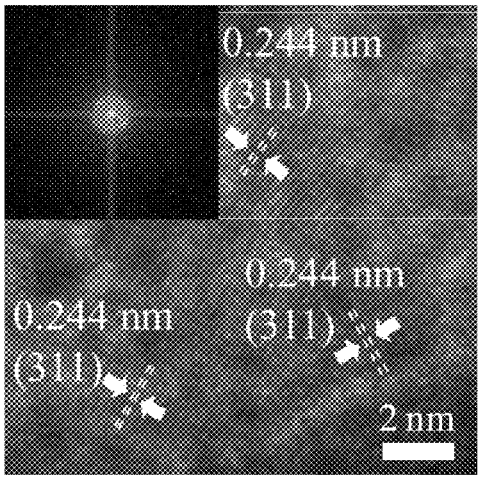
Figure 10:
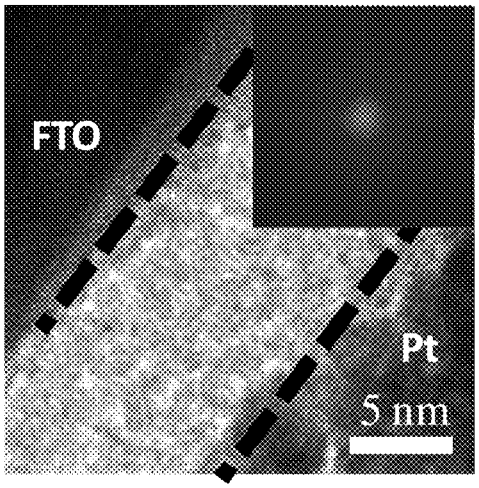

wherein insets in FIGS. 8-10 are corresponding Fourier transform patterns of the CMOH area.

Figure 11:
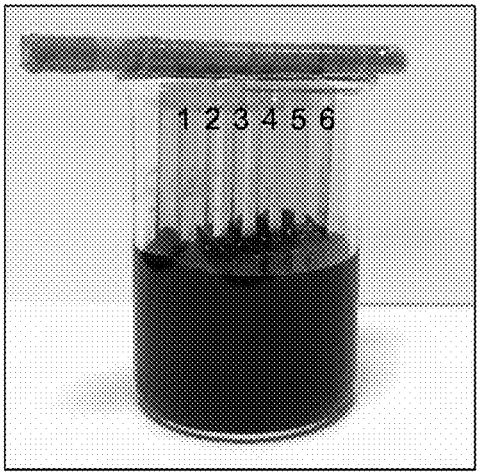
Figure 12:
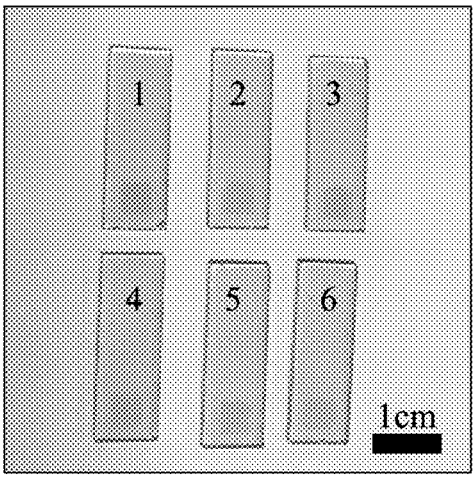
Figure 13:
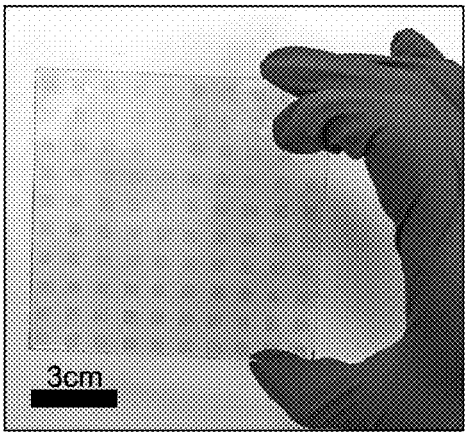
Figure 14:
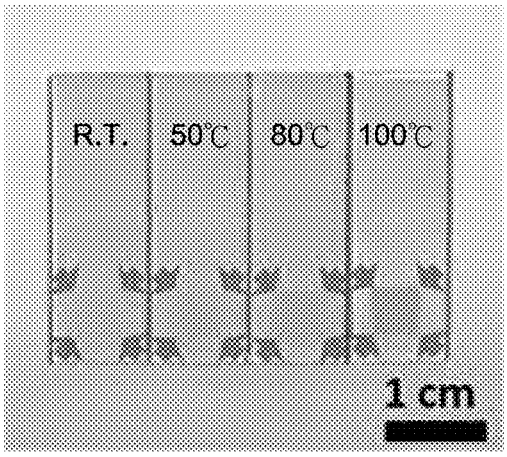
Figure 15:
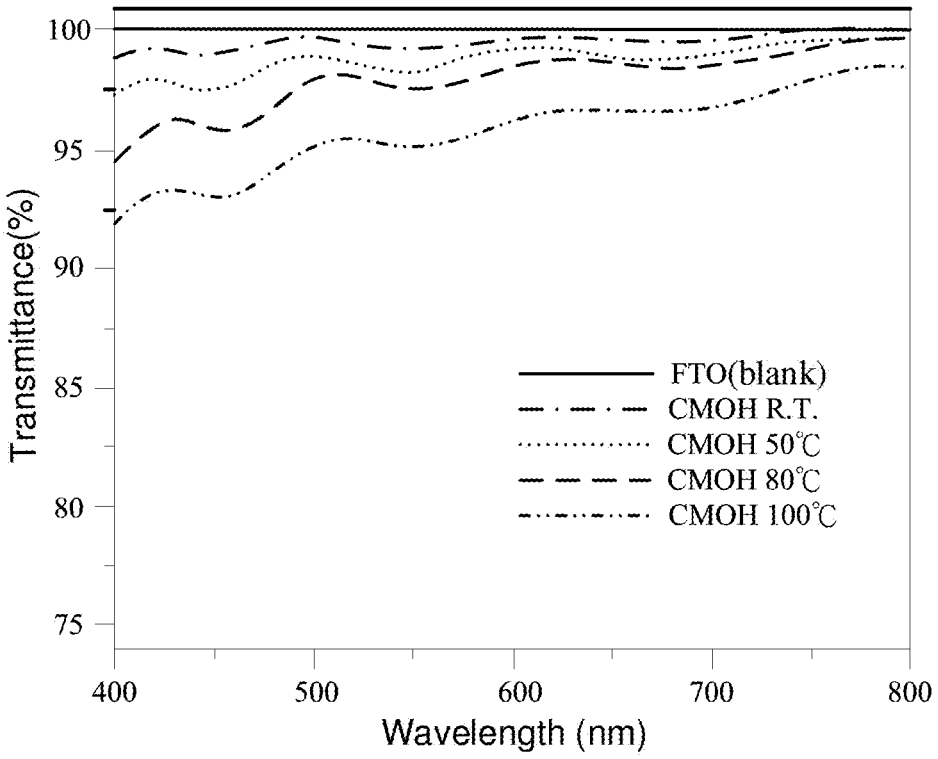
Figure 16:
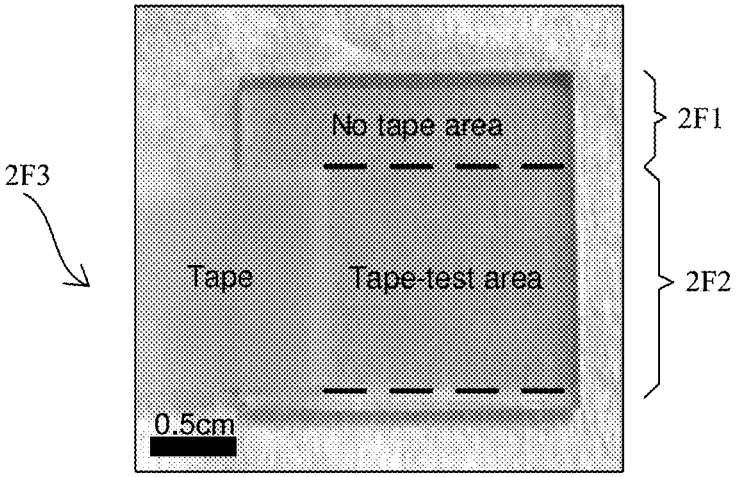
Figure 17:
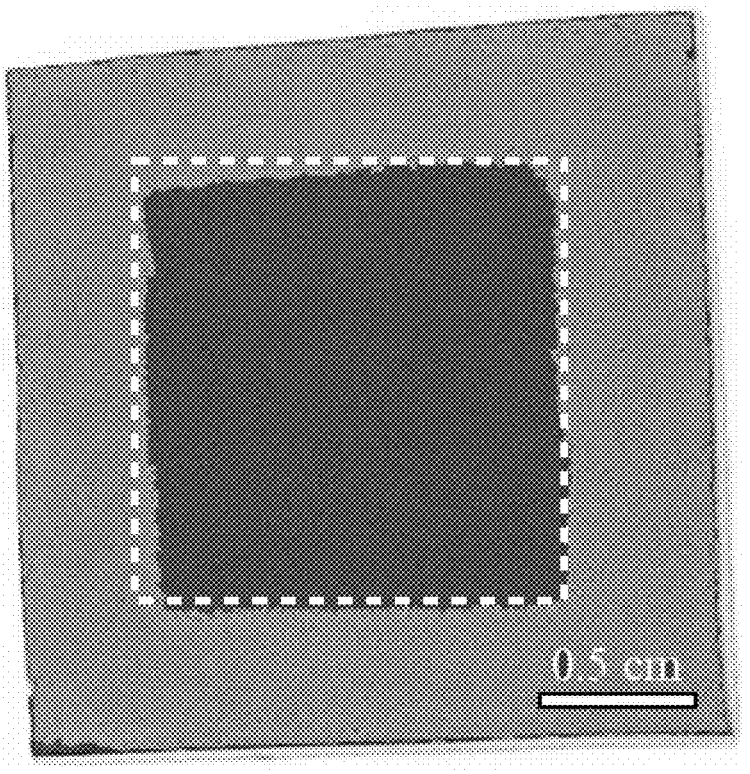
Figure 18:
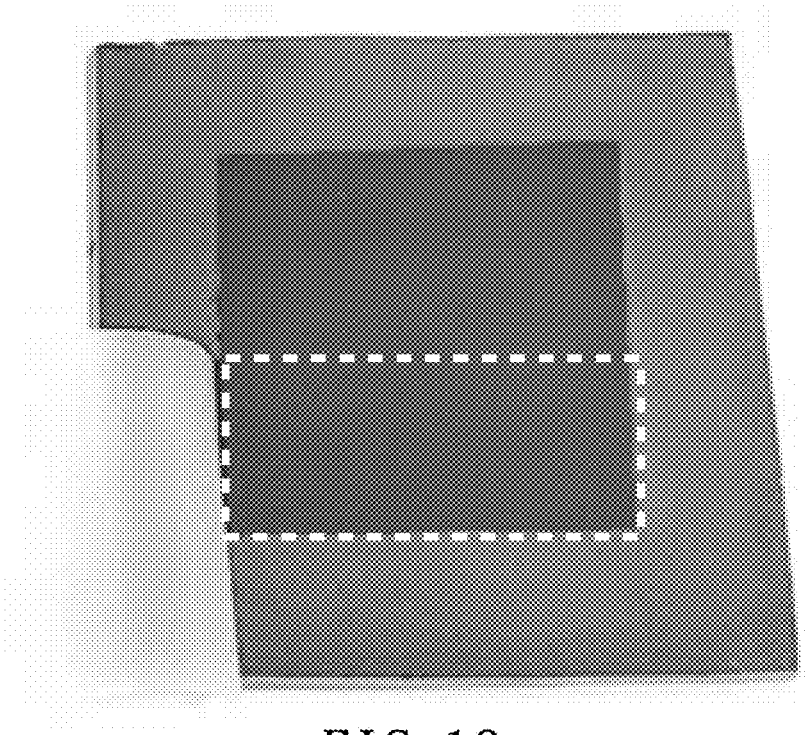
Figure 19:
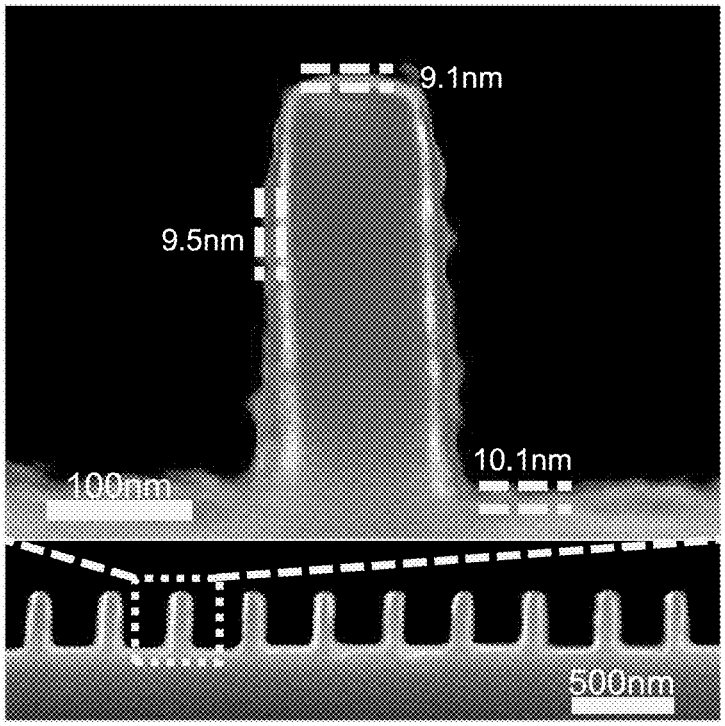
Figure 20A:
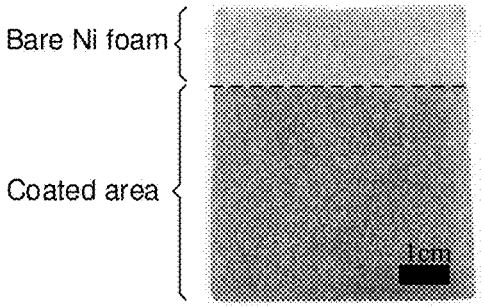
Figure 20B:
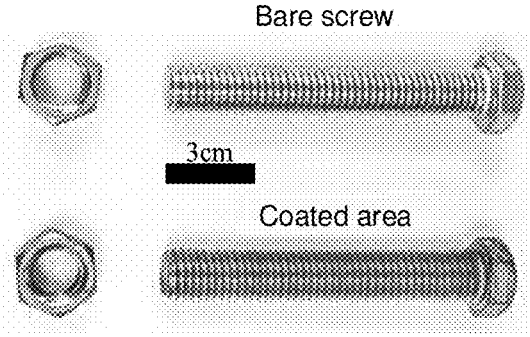
Figure 20C:
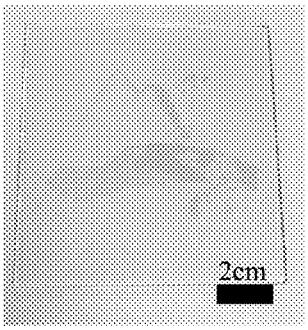
Figure 20D:
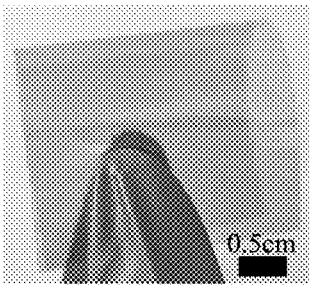
Figure 20E:
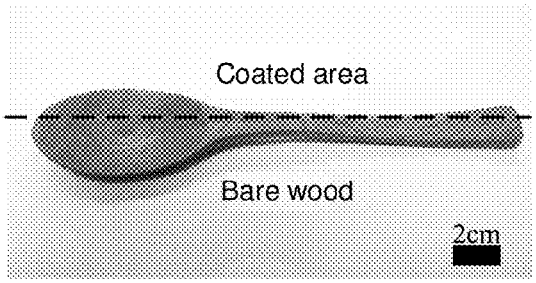
Figure 20F:
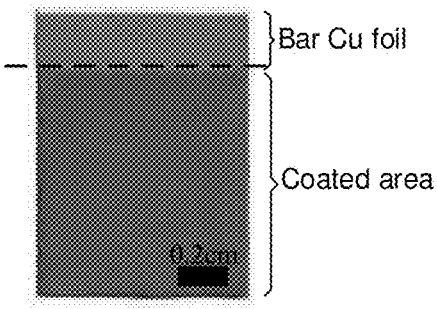

FIGS. 11-18 are schematic diagrams (1) to (8) that illustrate deposition condition tests; wherein:

FIG. 11 shows a diagram of photographs of parallel deposition on six individual FTO substrates;

FIG. 12 shows a diagram of products of six coated FTO films from FIG. 11 with uniform coating contrasts;

FIG. 13 shows a diagram of Large scale deposition of CMOH with a highly ordered array over a 100 $cm^2$ FTO film;

FIG. 14 shows a diagram of CMOH deposition at room temperature (R.T.) and others, wherein arrows indicate the corners of the deposition areas;

FIG. 15 shows a diagram of transparency of CMOH coatings shown in FIG. 14;

FIG. 16 shows a diagram of CMOH adhesion tests by Scotch tape peeling for more than 100 cycles;

FIG. 17 shows a diagram of the amorphous binary metal oxide hydroxide film including the iron (Fe) atom and the cobalt (Co) atom by Scotch peeling for more than 100 cycles, and the formed amorphous binary metal oxide hydroxide film is surrounded by white dashed line;

FIG. 18 shows a diagram of the amorphous binary metal oxide hydroxide film including the iron (Fe) atom and the cobalt (Co) atom by Scotch peeling for more than 100 cycles, and the peeled region is surrounded by white dashed line;

FIG. 19 shows a diagram of a cross-section profile of CMOH coating on a Si trench; and FIGS. **20*a*-20*f* show diagrams of tests of arbitrary substrate deposition, wherein FIG. 20*a* shows a diagram of CMOH coated on 3D porous Ni foam with the comparison of bare Ni foam, FIG. 20*b* shows a diagram of homogeneous deposition on the cylinder-shape surface of screw pairs, FIG. 20*c* shows a diagram of CMOH coating with transfer of large-size complicated patterns onto a 100 $cm^2$ glass substrate by masking, FIG. 20*d* shows a diagram of the CMOH coated PET, where no appreciable cracking can be observed after bending and folding for 100 cycles, FIG. 20*e* shows a diagram of the CMOH coated curved wooden surface, and FIG. 20*f*** shows a diagram of CMOH coated on the metallic surface of Cu foils.

Figure 21:
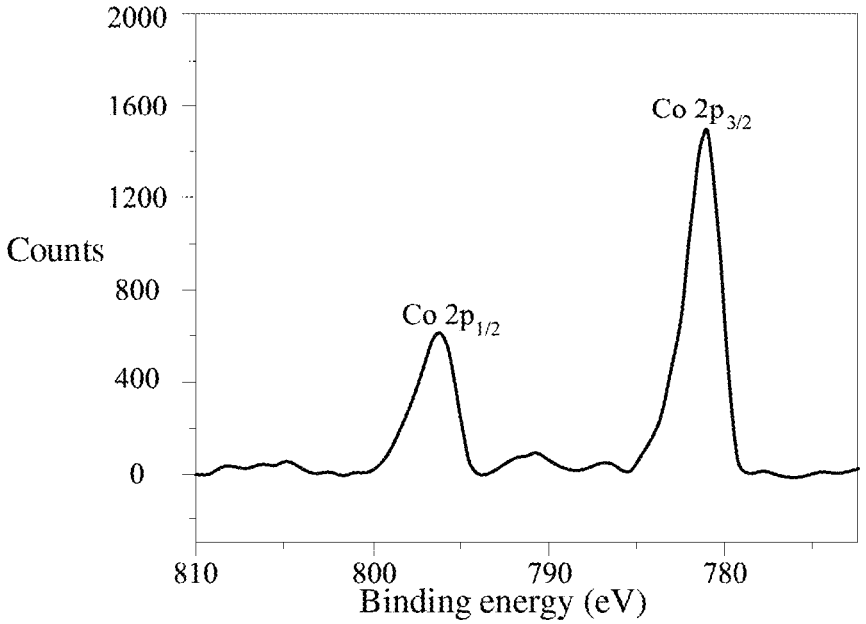
Figure 22:
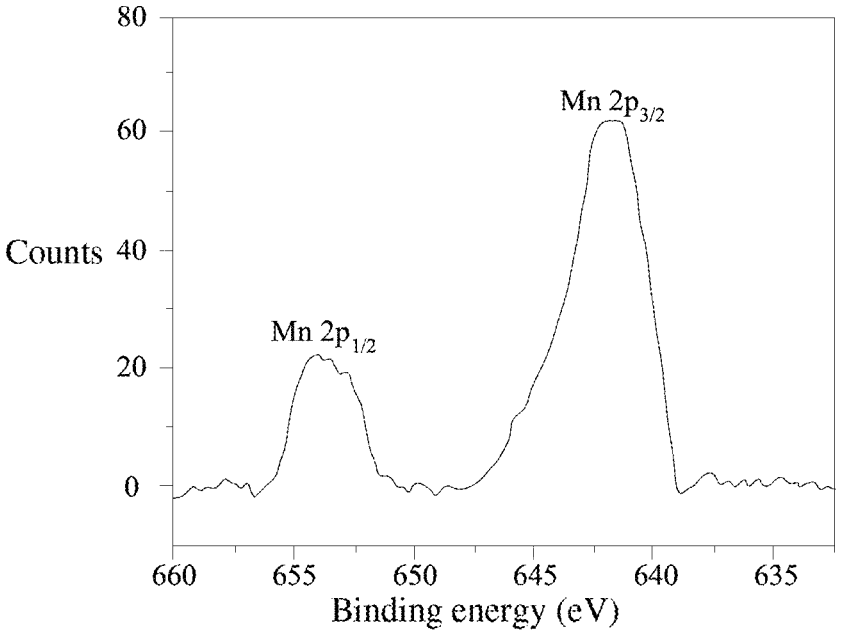
Figure 23:
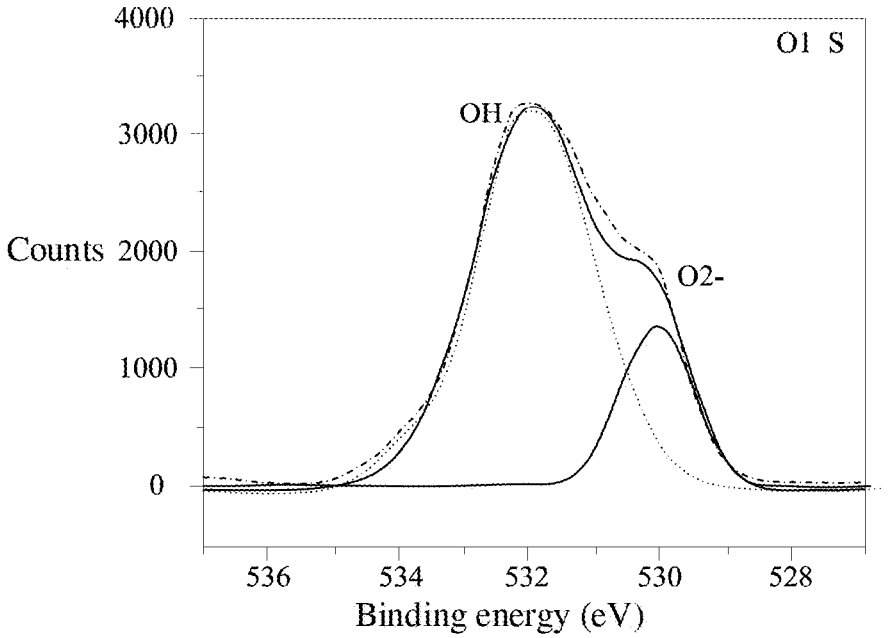
Figure 24:
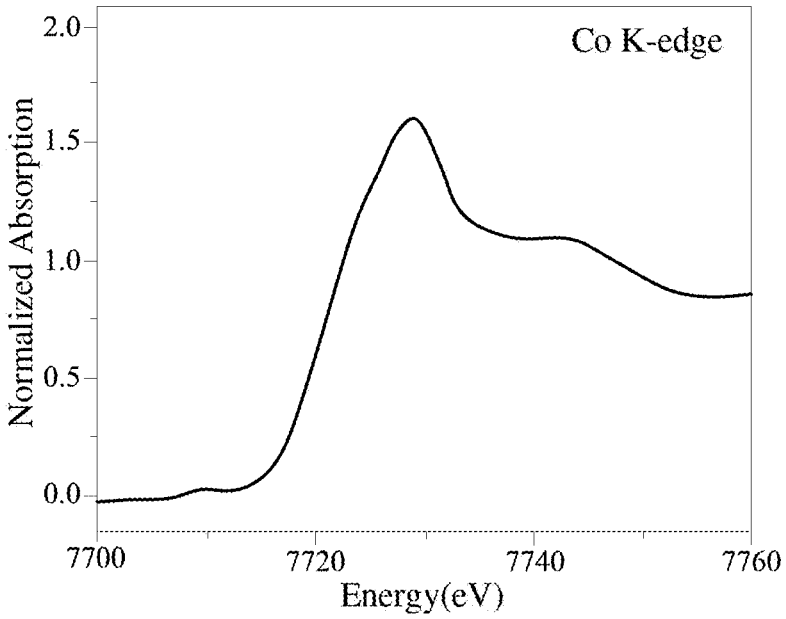
Figure 25:
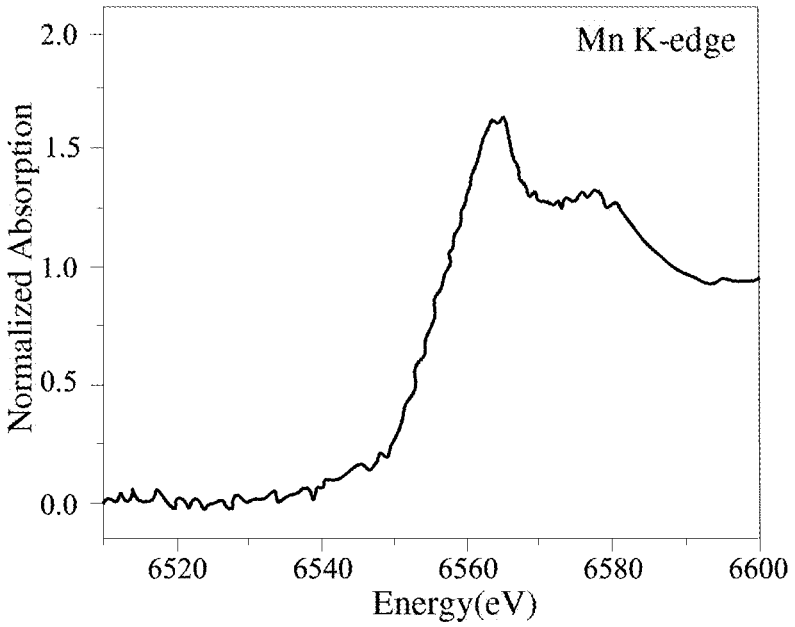

FIGS. 21-26 are schematic diagrams (1) to (6) that illustrate spectroscopic and profile studies of CMOH; wherein:

FIG. 21 shows a diagram of XPS data of Co 2p for uncalcined coating;

FIG. 22 shows a diagram of XPS data of Mn 2p for uncalcined coating;

FIG. 23 shows a diagram of XPS data of O 1 s for uncalcined coating;

FIG. 24 shows a diagram of XAS spectra of Co K-edge;

FIG. 25 shows a diagram of XAS spectra of Mn K-edge; and

Figure 26:
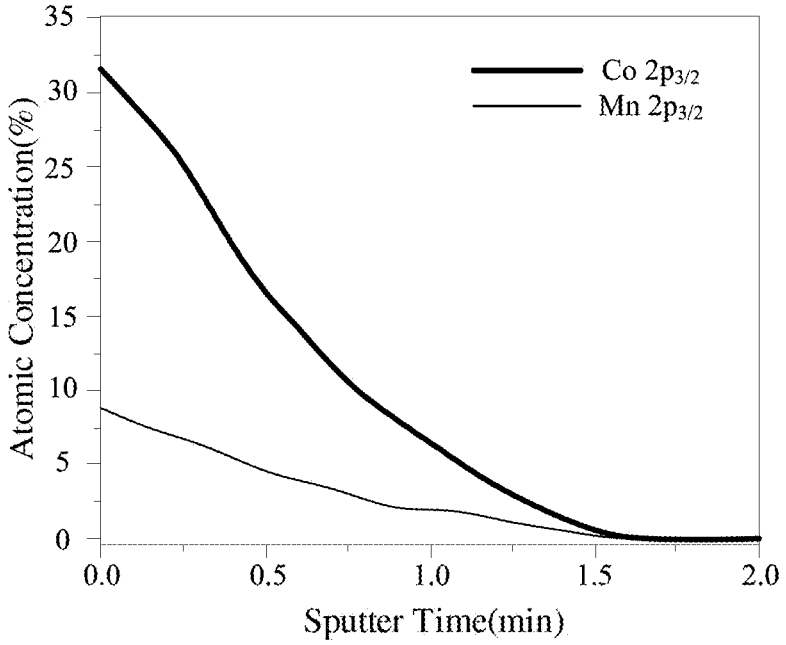

FIG. 26 shows a diagram of film composition profile.

Figure 27:
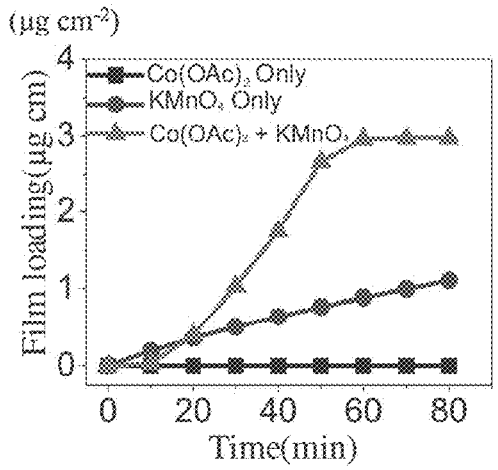
Figure 28:
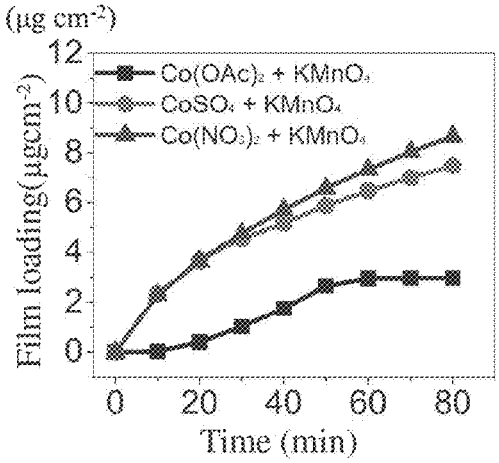
Figure 29:
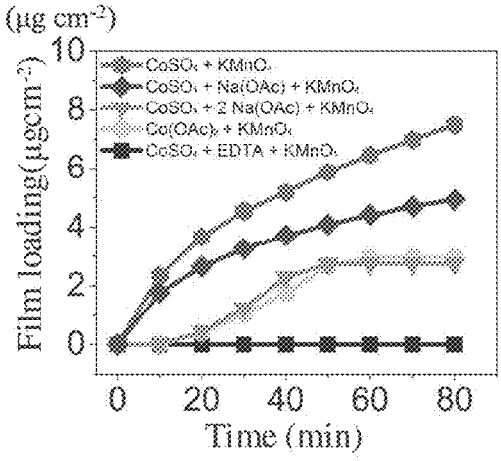
Figure 30:
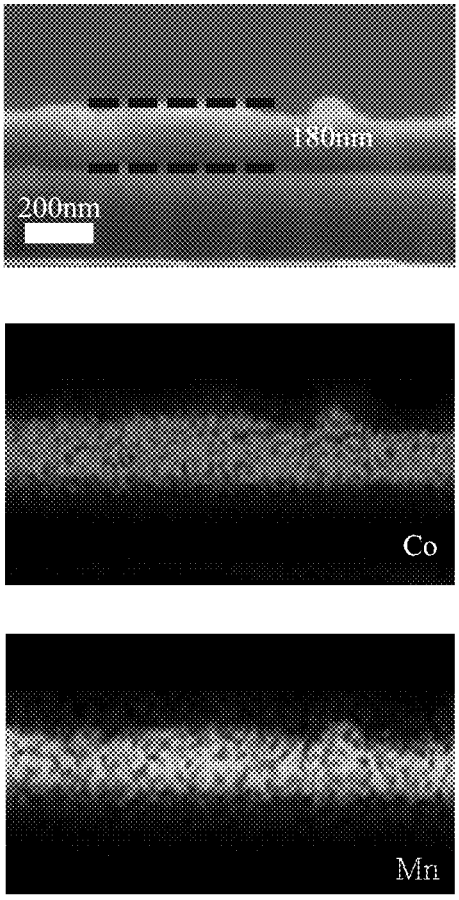
Figure 31:
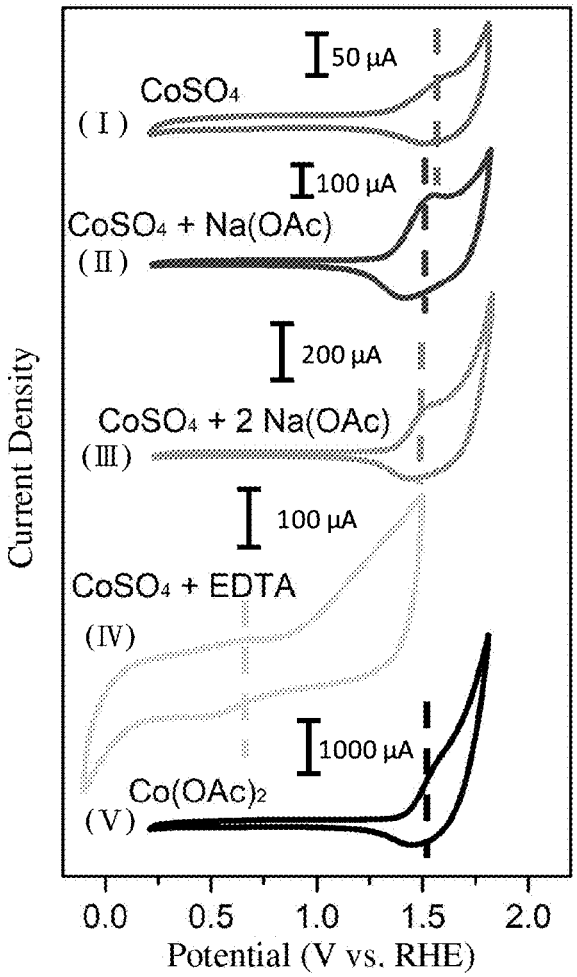

FIGS. 27-31 are schematic diagrams (1) to (5) that illustrate QCM studies of film growth with different precursor recipes, wherein all tests were conducted under identical preparation conditions; wherein:

FIG. 27 shows a diagram of a comparison of cobalt and manganese precursor-only cases with the two precursor mixed condition;

FIG. 28 shows a diagram of a comparison of different anions in the cobalt precursors;

FIG. 29 shows a diagram of the effect of additional ligands on CMOH growth;

FIG. 30 shows a diagram of a cross-sectional SEM image and EDXS mapping of CMOH prepared by $CoSO_4$; and FIG. 31 shows a diagram of CVs of cobalt precursors with different anions and ligands.

Figure 32:
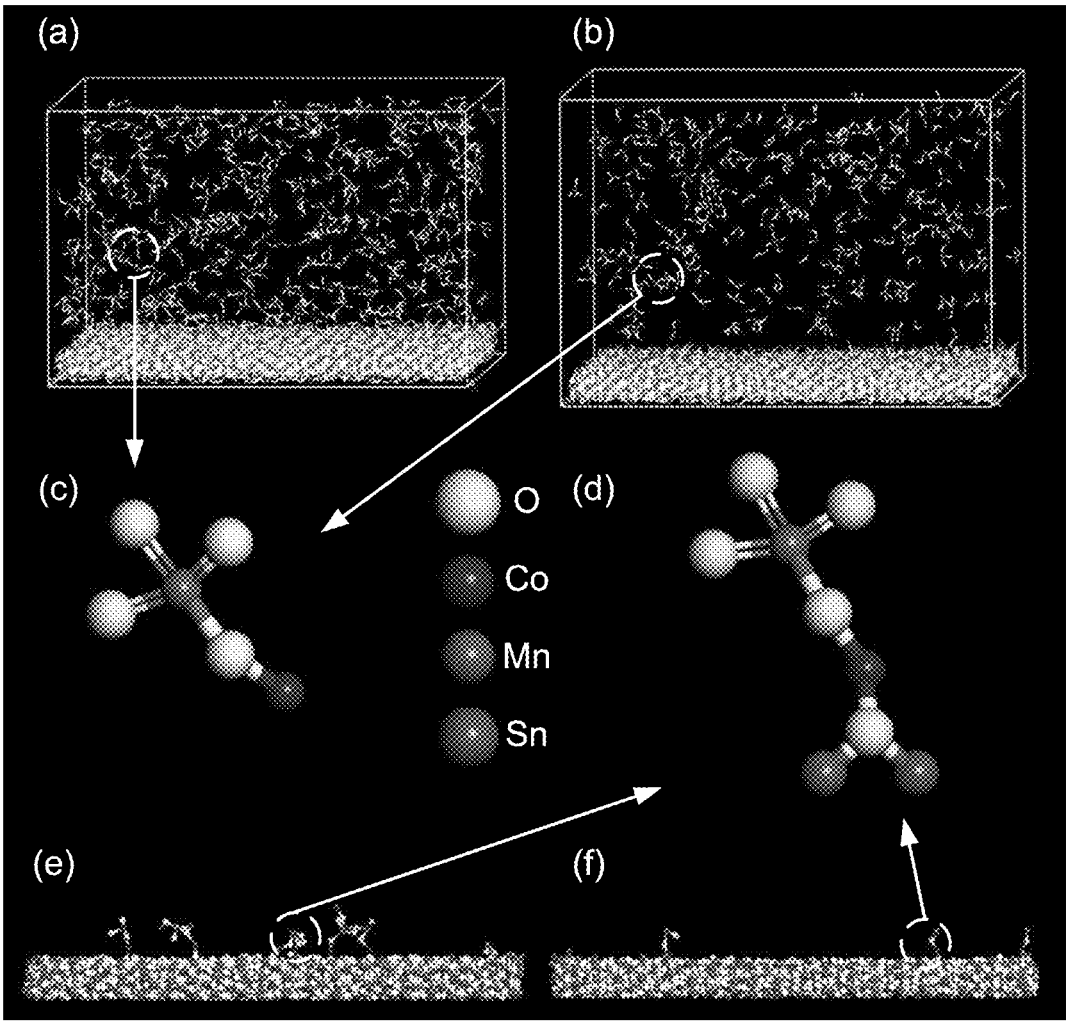
Figure 33:
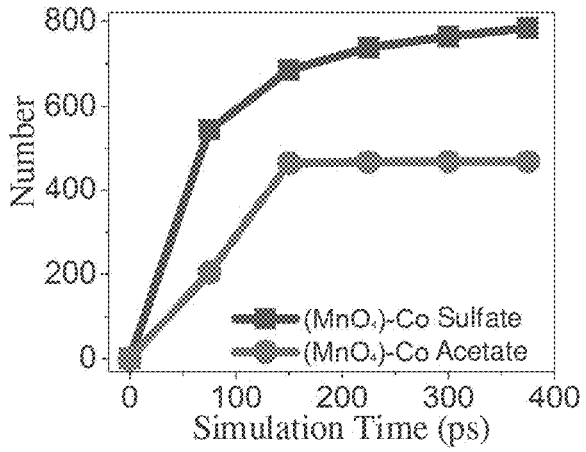
Figure 34:
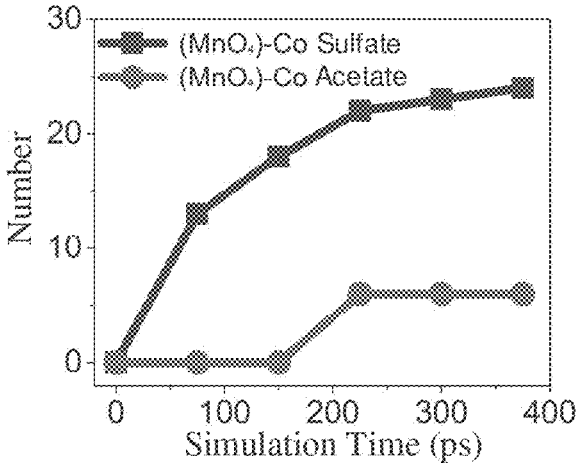
Figure 35:
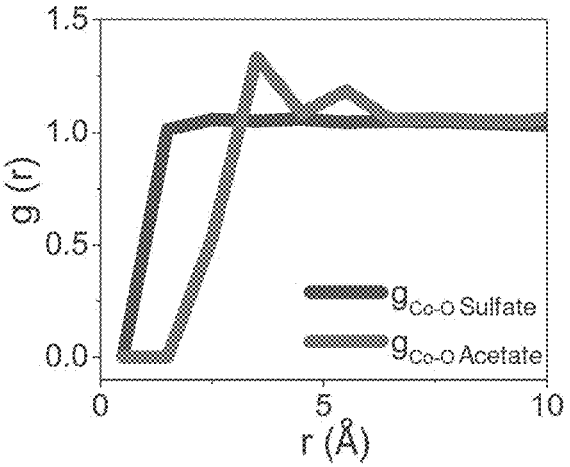

FIGS. 32-35 are schematic diagrams (1) to (4) that illustrate MD simulated studies and analysis of CMOH growth; wherein:

FIG. 32 shows diagrams (a) to (f) illustrating MD simulated studies of CMOH growth, wherein (a) and (b) are illustrations of simulation cells of the sulfate system and acetate system while the simulation is in progress after linking, removal of all the unreacted $Co^{2+}$ and $MnO_4^-$ ions, counter ions ($OAc^-$, $SO_4^{2-}$), and solvent ($H_2O$) was conducted to enable the clear presentation of ($MnO_4$)—Co complexes; (c) is an enlarged view of a ($MnO_4$)—Co complex as a colloidal precipitate in cells (a) and (b); (d) is an enlarged view of surface-linked ($MnO_4$)—Co complexes (CMOH film) deposited on the $SnO_2$ substrate in (e) the sulfate system and (f) the acetate system;

FIG. 33 shows a diagram of numbers of Co—O—Mn bonds of the colloidal complexes, analyzed from cells of (a) and (b) in FIG. 32;

FIG. 34 shows a diagram of numbers of Co—O—Mn bonds of the surface linked complexes, analyzed from (e) and (f) in FIG. 32; and FIG. 35 shows a diagram of RDF analysis of $Co^{2+}$ ions with O atoms of acetate ($O_{acetate}$) and sulfate ($O_{sulfate}$) ions.

Figure 36:
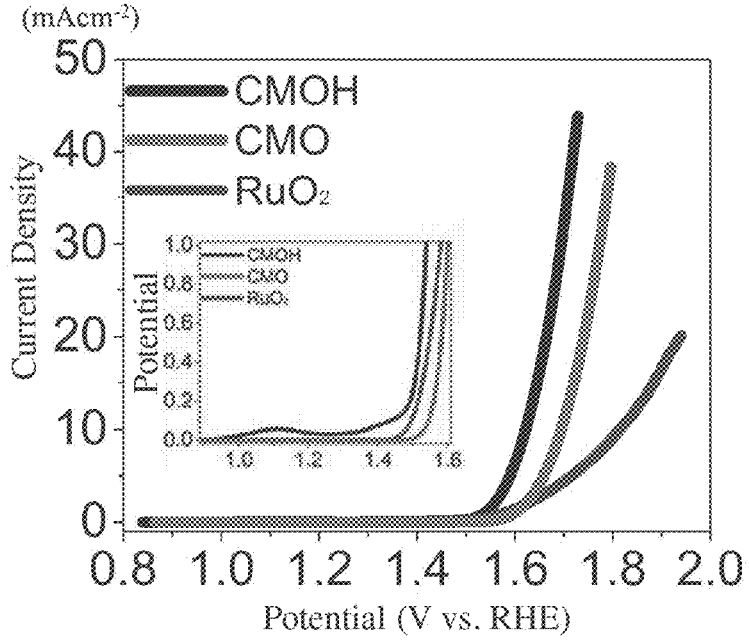
Figure 37:
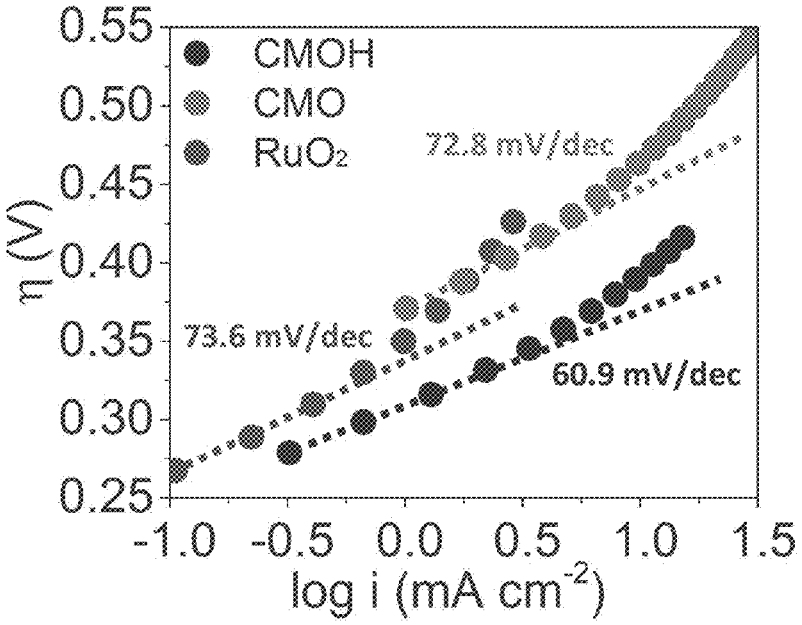
Figure 38:
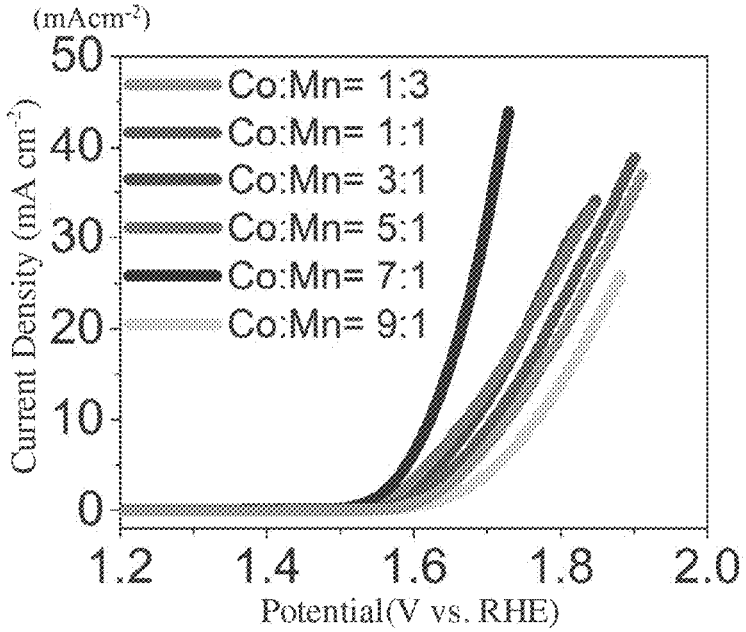
Figure 39:
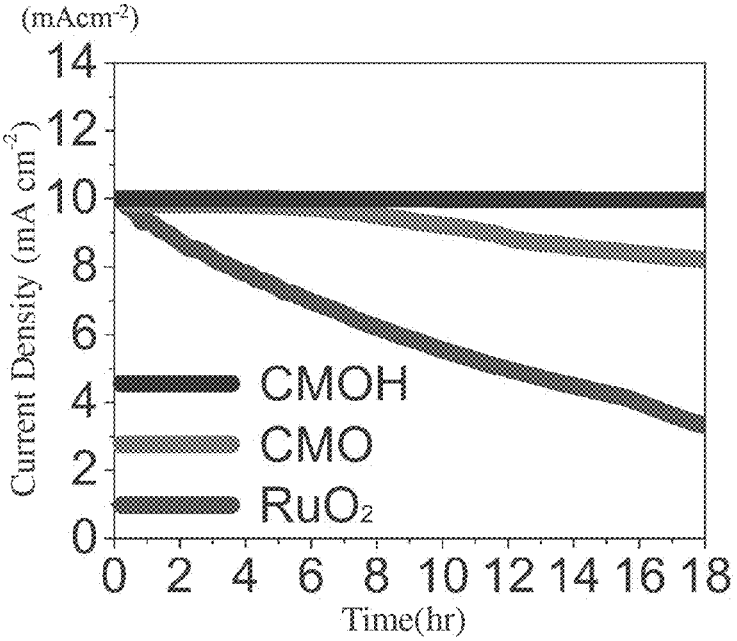
Figure 40:
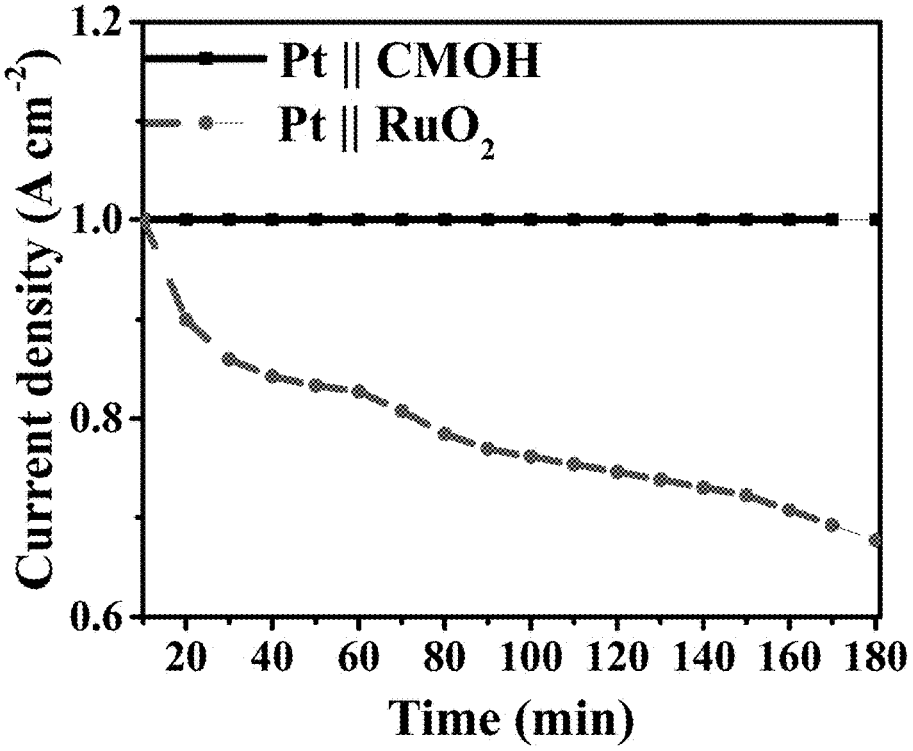
Figure 41:
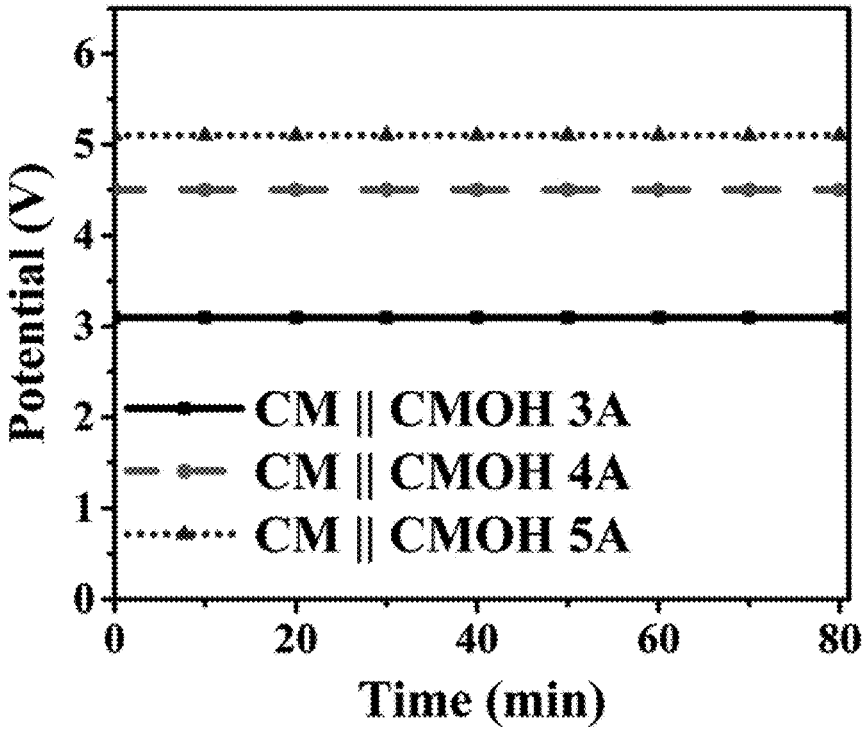
Figure 42:
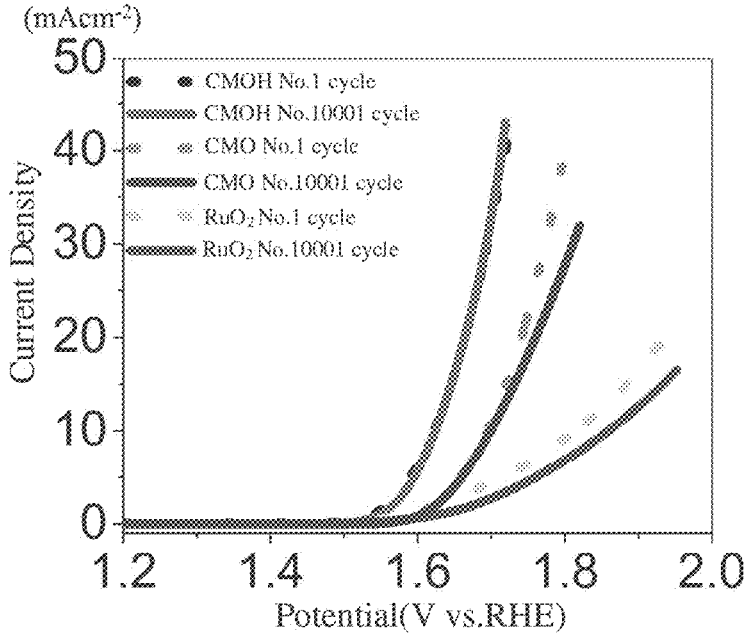
Figure 43:
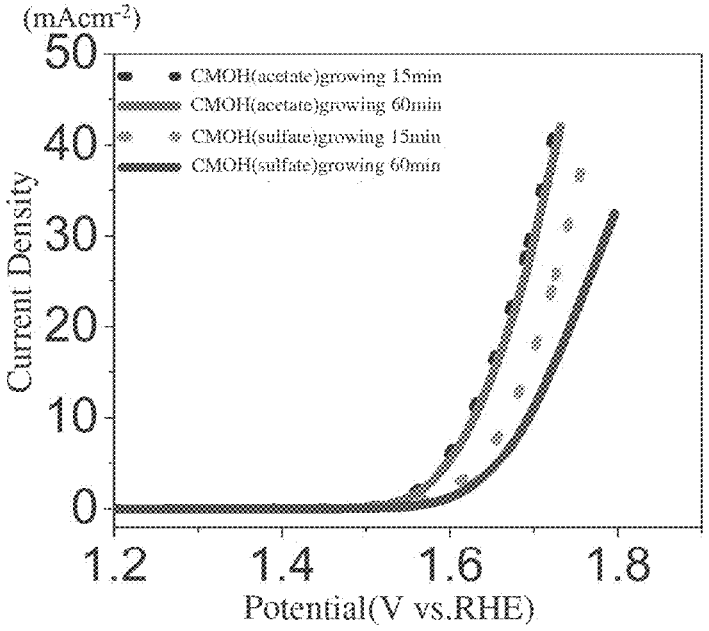

FIGS. 36-43 are schematic diagrams (1) to (6) that illustrate electrocatalytic oxygen evolution studies of CMOH coatings on FTO; wherein:

FIG. 36 shows a diagram of a comparison of amorphous CMOH and calcined CMO with benchmark $RuO_2$ recorded at 0.1 M KOH and an inset in FIG. 36 is a zoom-in plot;

FIG. 37 shows a diagram of the Tafel plot comparison of materials in FIG. 34;

FIG. 38 shows a diagram of current density-potential curves of CMOH coatings produced with varied Co-to-Mn ratios in the reaction mixtures;

FIG. 39 is stability comparison between amorphous coating, crystalline coating and commercial coating in i-t curves;

FIG. 40 is stability comparison between amorphous coating and commercial coating in i-t curves;

FIG. 41 is a stability comparison under high test current density in voltage-time curves;

FIG. 42 is a stability comparison between amorphous and crystalline coatings in LSV cycle tests; and FIG. 43 is a comparison of coatings with different cobalt precursors.

Figure 44:
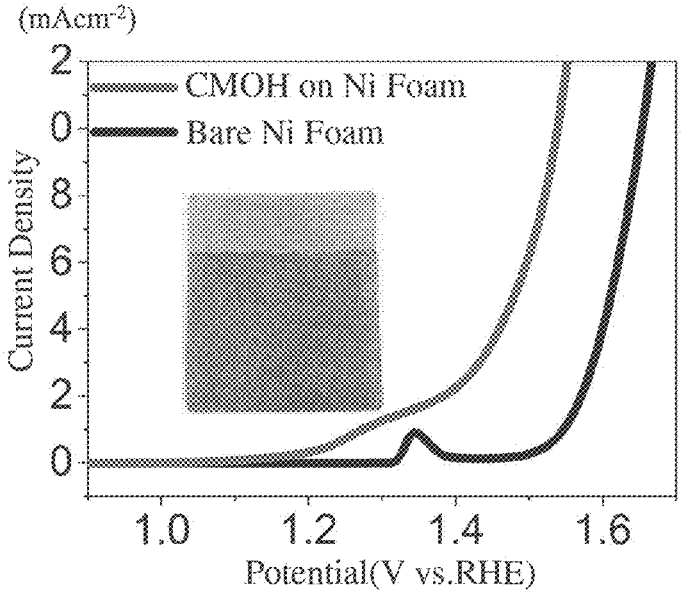
Figure 45:
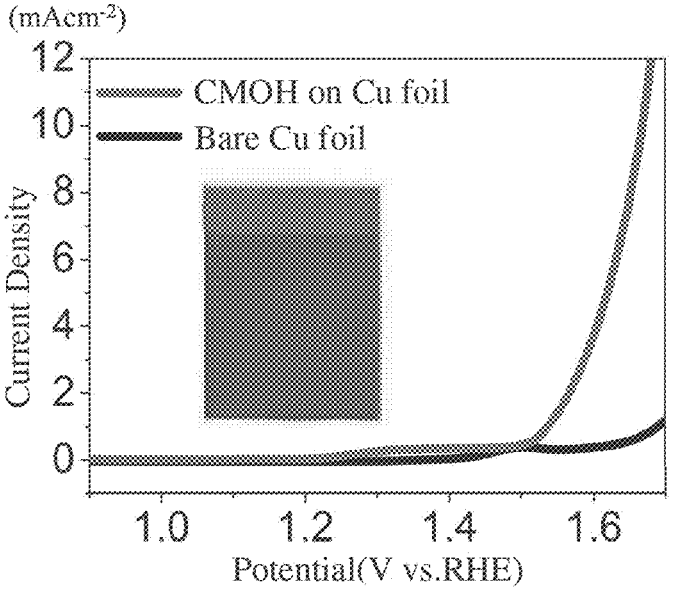
Figure 46:
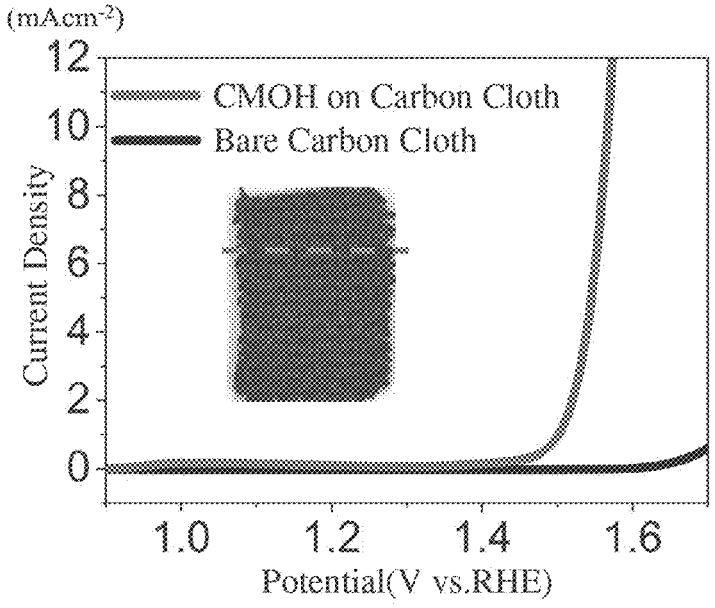
Figure 47:
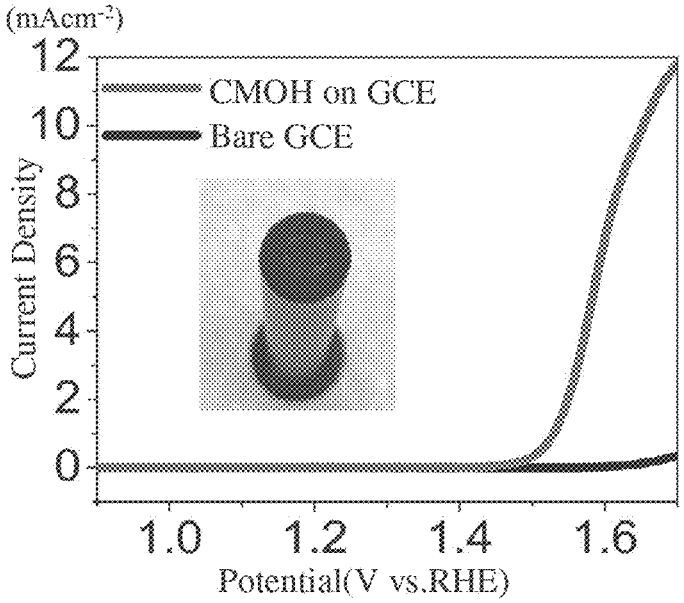

FIGS. 44-47 are schematic diagrams (1) to (4) that illustrate current density-potential curve comparisons of amorphous CMOH coated on typical substrates for the OER; wherein:

FIG. 44 shows a diagram of a schematic diagram of a current density-potential curve comparison of amorphous CMOH coated on Ni foam;

FIG. 45 shows a diagram of a schematic diagram of a current density-potential curve comparison of amorphous CMOH coated on Cu foils;

FIG. 46 shows a diagram of a schematic diagram of a current density-potential curve comparison of amorphous CMOH coated on carbon cloth; and FIG. 47 shows a diagram of a schematic diagram of a current density-potential curve comparison of amorphous CMOH coated on glassy carbon electrode (GCE).

Figure 48:
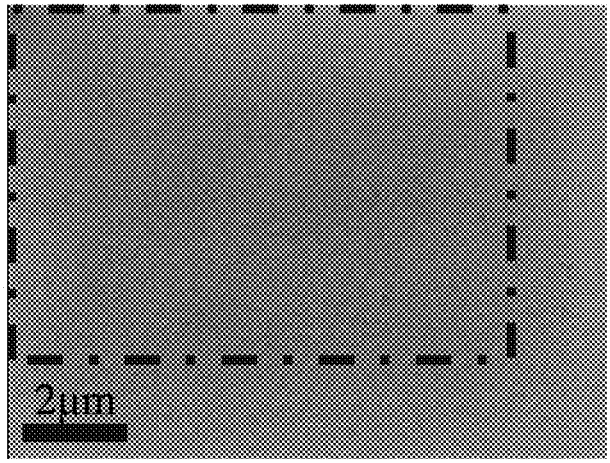
Figure 49:
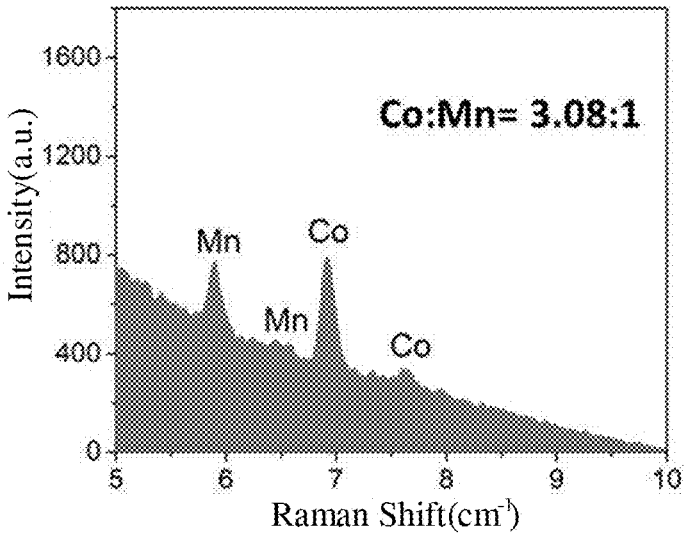
Figure 50:
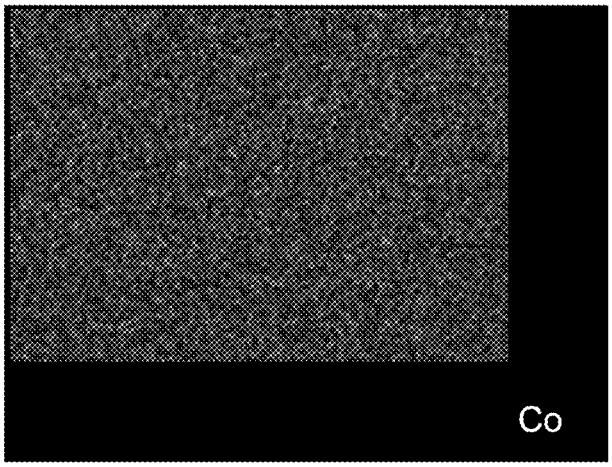
Figure 51:
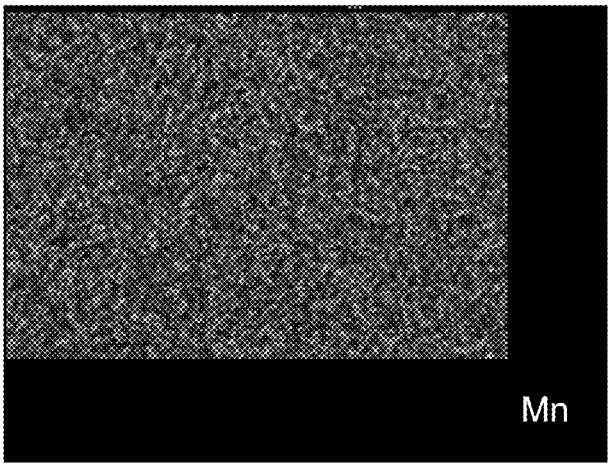

FIGS. 48-51 are schematic diagrams (1) to (4) that illustrate the EDXS results of $CMOH_{acetate}$; wherein:

FIG. 48 shows a diagram of SEM images of CMOH with the selected area highlighted by red dashed lines for mapping analysis;

FIG. 49 shows a diagram of the EDXS results show the signals of Co and Mn with the atomic ratios of Co/Mn=3.08; and FIG. 50 and FIG. 51 show diagrams of mapping results of Co and Mn distribution corresponding to a dashed line area in FIG. 48.

Figure 52:
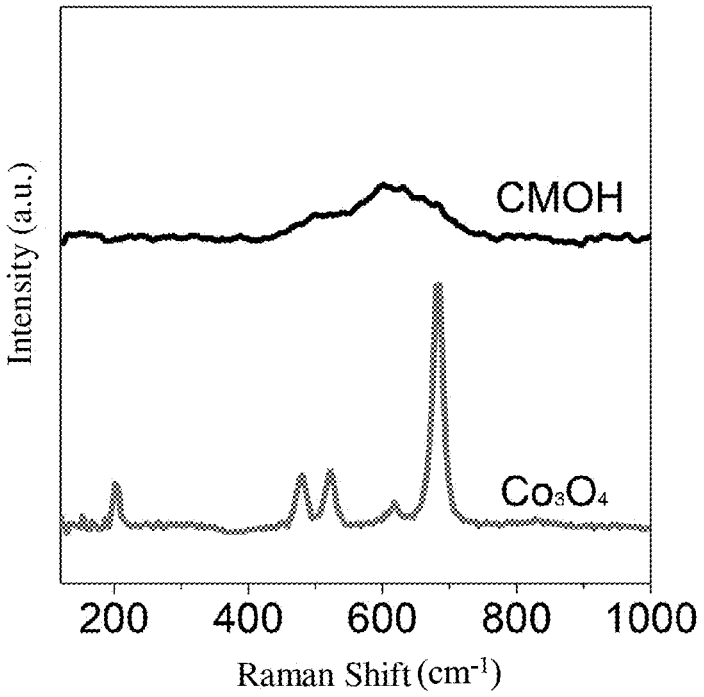

FIG. 52 shows a schematic diagram that illustrates the Raman spectra of CMOH show a broad band at 599 $cm^{-1}$, indicating the presence of amorphous cobalt oxide, and the Raman signals of crystalline $Co_3O_4$ are shown for comparison, according to an embodiment of the present disclosure.

Figure 53:
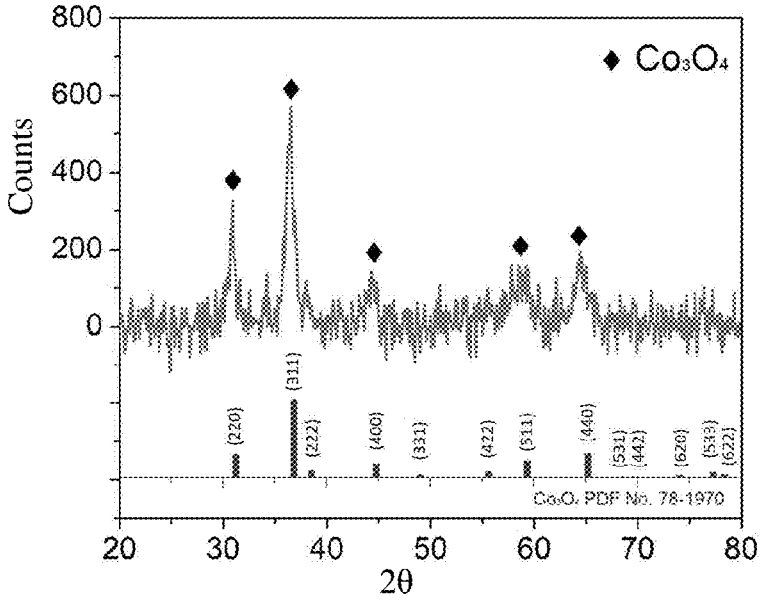

FIG. 53 shows a schematic diagram that illustrates the GIXRD pattern of the $CMOH_{sulfate}$ after a calcination at 500° C., showing phases corresponding to $Co_3O_4$, according to an embodiment of the present disclosure.

Figure 54:
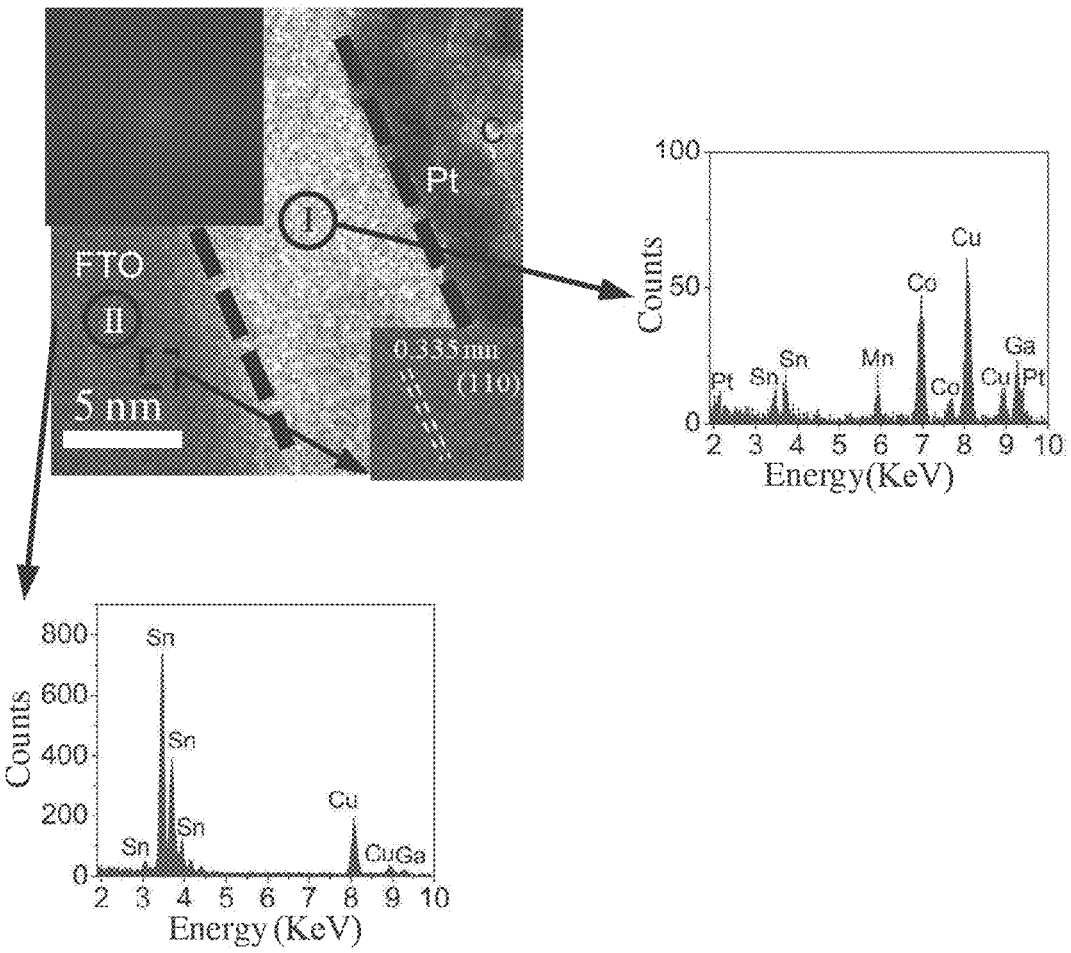

FIG. 54 shows a schematic diagram that illustrates a characterization of $CMOH_{acetate}$ cross-section under HR-TEM (also see FIG. 8). The label of I in the film area shows the EDXS signals with the majority of Co and Mn. The upper left inset shows the FFT patterns of I corresponding to an amorphous characteristic. The area labeled by II of FTO exhibits the strong Sn signal. The corresponding high resolution TEM images (the lower right inset) show a lattice corresponding to (110) of FTO. Ga signal is due to the ion-beam of Ga in FIB, according to an embodiment of the present disclosure.

Figure 55:
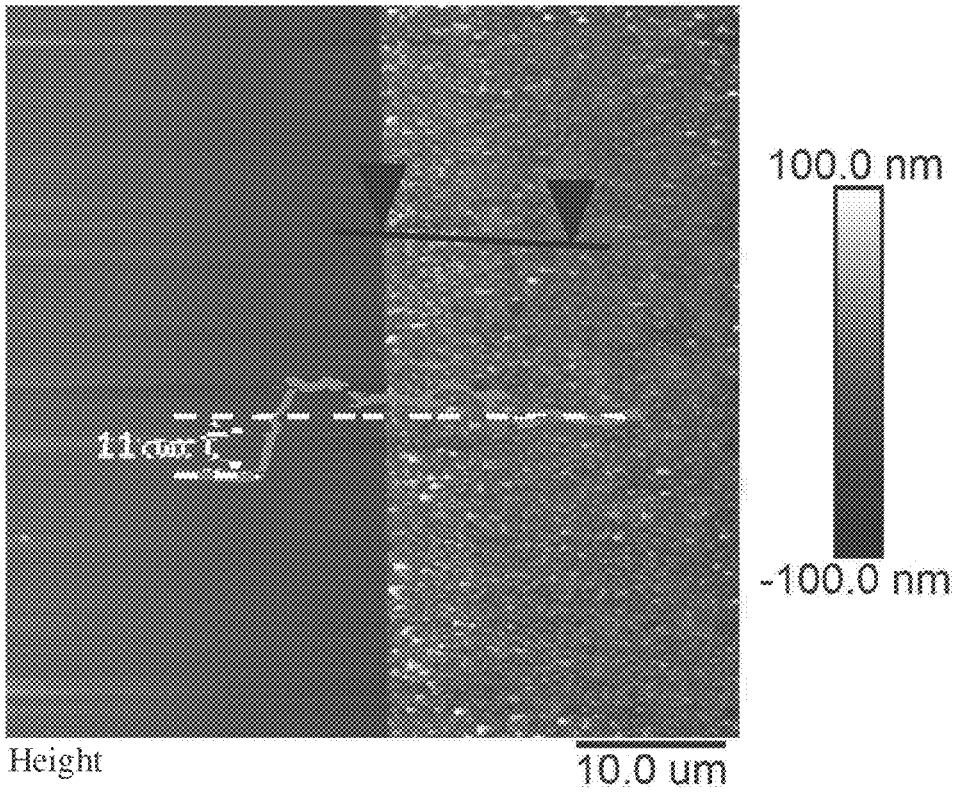

FIG. 55 shows a schematic diagram that illustrates AFM results of $CMOH_{acetate}$ show the film thickness around 11 nm prepared at 80° C. for 60 minutes.

Figure 56:
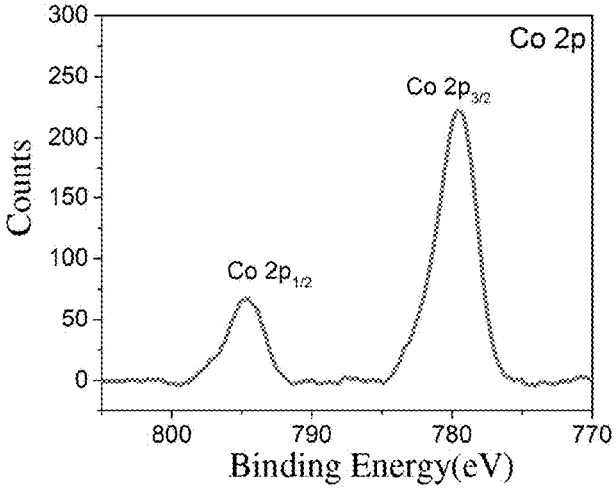
Figure 57:
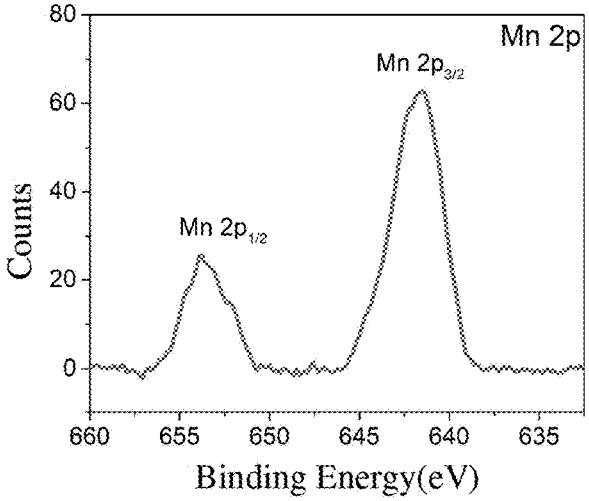
Figure 58:
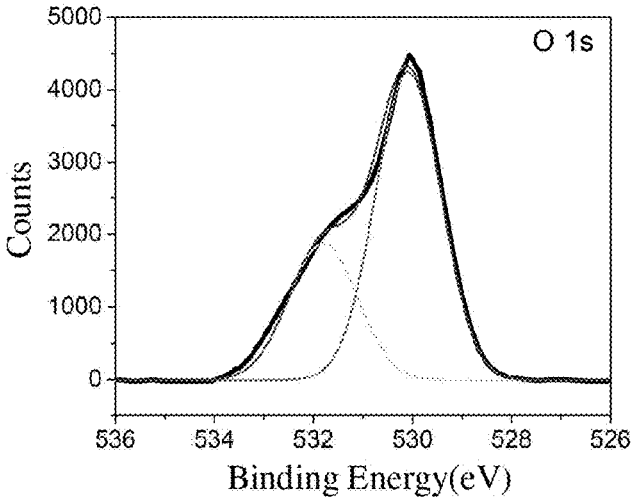

FIGS. 56-58 are schematic diagrams that illustrate the XPS data of the crystalline $CMO_{acetate}$ after annealing at 500° C.; wherein:

FIG. 56 shows a diagram of the XPS data of Co 2p;

FIG. 57 shows a diagram of the XPS data of Mn 2p; and

FIG. 58 shows a diagram of the XPS data of O 1 s.

Figure 59:
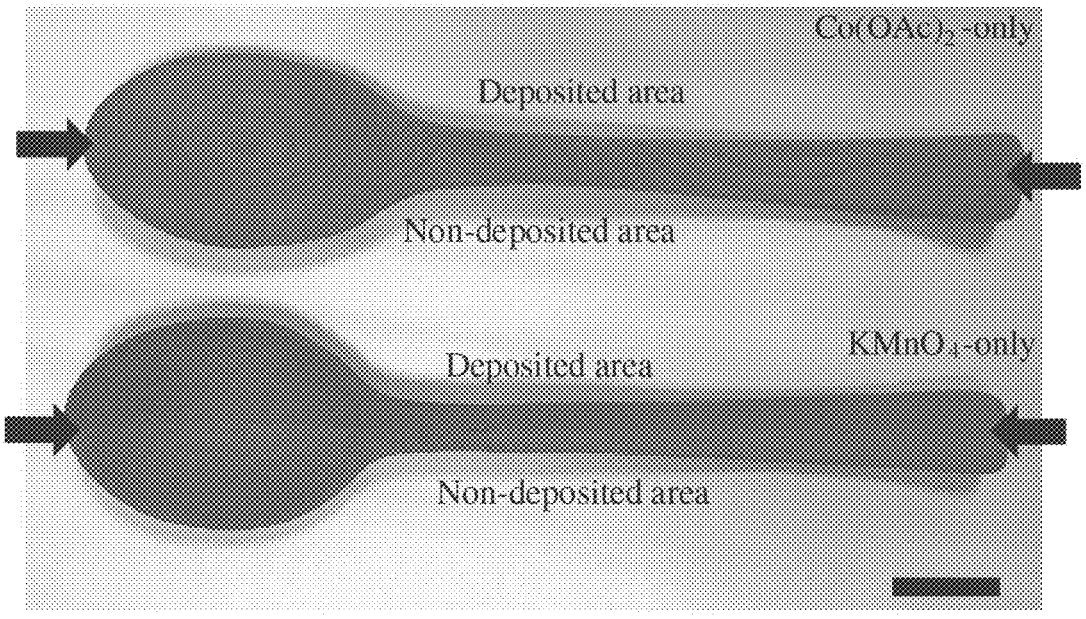
Figure 60:
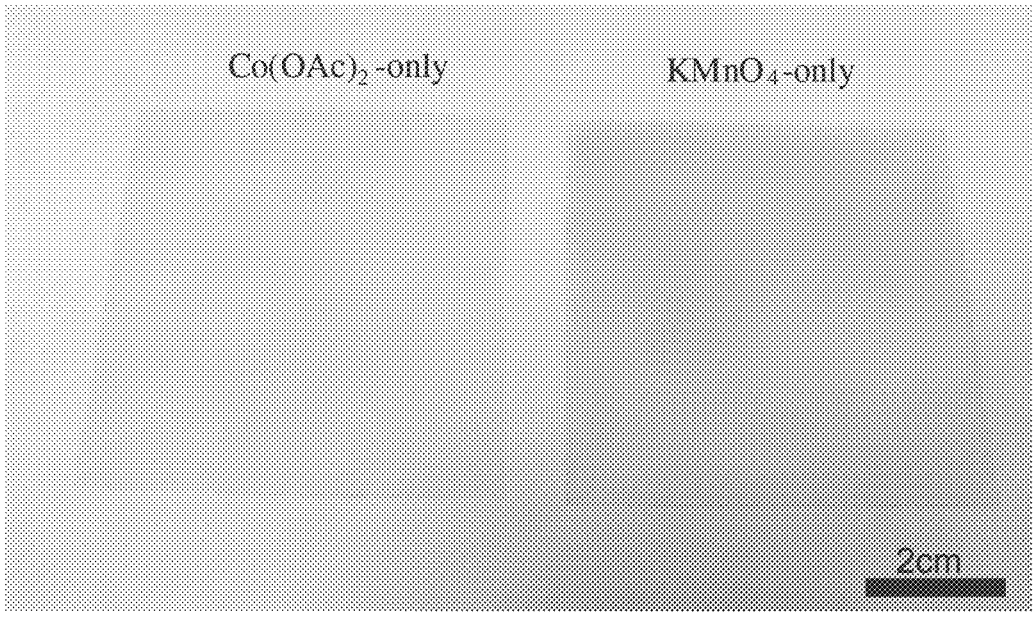

FIGS. 59-60 are schematic diagrams that illustrate photographs of $Co(OAc)_2$-only and $KMnO_4$-only deposition on nonmental substrates of wood (see FIG. 59) and PET (see FIG. 60), wherein arrows in FIG. 59 indicate the boundary between deposition and deposition-free areas for comparison, and these results show no film formation by $Co(OAc)_2$-only deposition, while thin coating can be observed by $KMnO_4$-only deposition.

Figure 61:
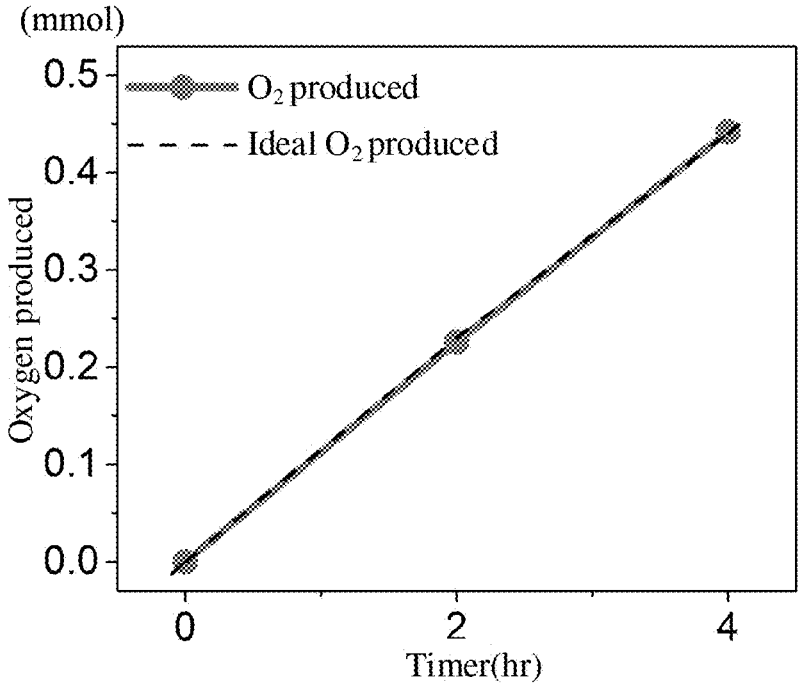

FIG. 61 shows a schematic diagram that illustrates a Faradaic efficiency test of $CMOH_{acetate}$ films. After four hours oxygen evolution, the films exhibit the Faradaic efficiency of nearly 100%.

Figure 62:
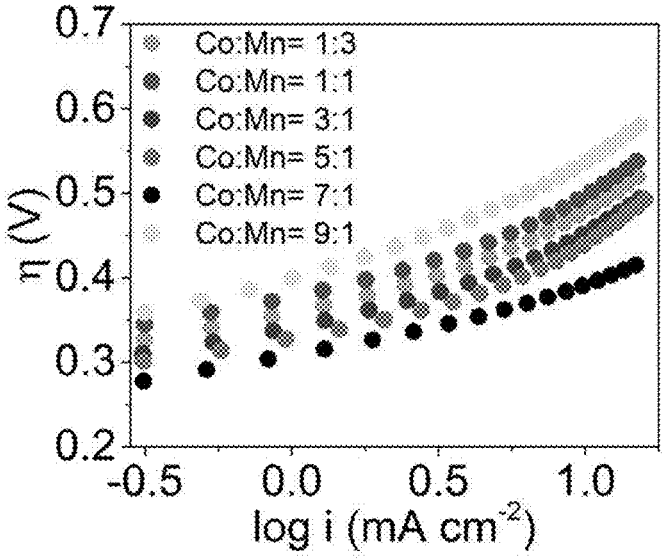

FIG. 62 shows a schematic diagram that illustrates the Tafel plots of $CMOH_{acetate}$ samples prepared by different Co/Mn precursor ratios at 80° C. for 15 minutes, wherein the Tafel slopes are summarized in the following table.

Figure 63:
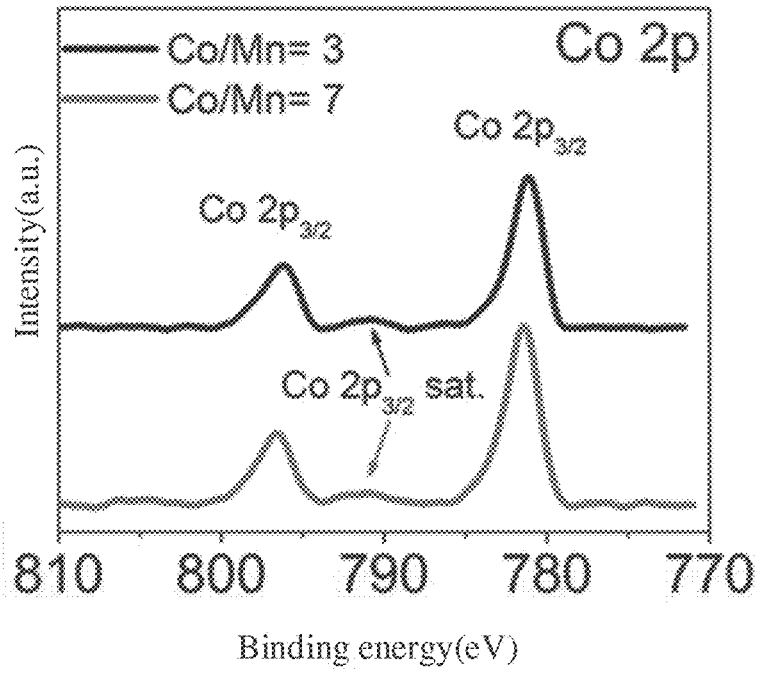

FIG. 63 shows a schematic diagram that illustrates cobalt XPS data of the $CMOH_{7/1}$ (Co/Mn precursor ratio of 7/1), showing the high similarity to $CMOH_{3/1}$ (Co/Mn precursor ratio of 3/1), indicating that $Co^{3+}$ is still the main species of the CMOH film.

Figure 64:
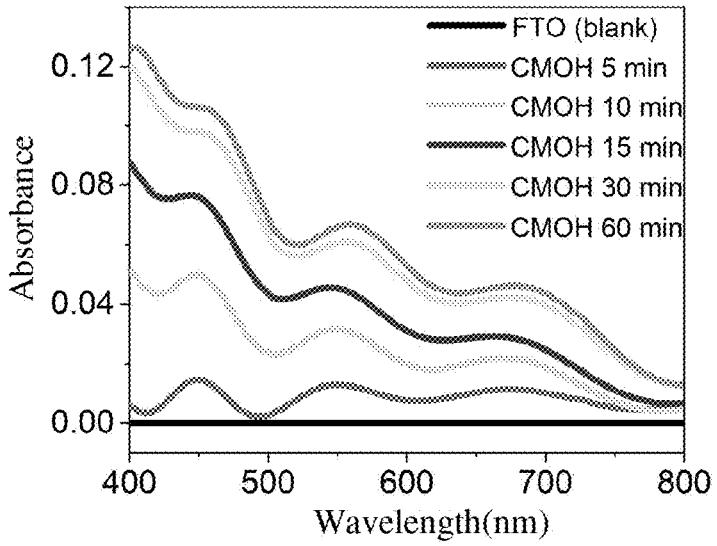

FIG. 64 shows a schematic diagram that illustrates UV-vis spectra of $CMOH_{acetate}$ deposited under varied deposition time at 80° C.

Figure 65:
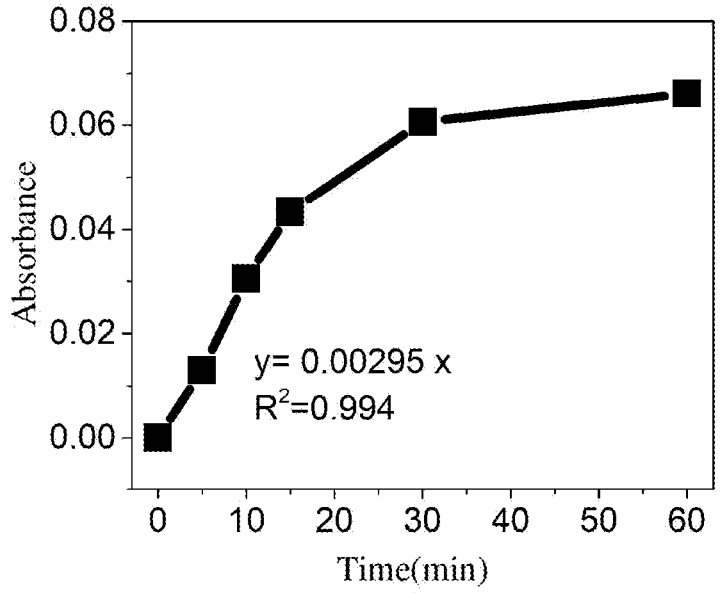

FIG. 65 shows a schematic diagram that illustrates a corresponding calibration curve of FIG. 64 with 550 nm absorbance.

Figure 66:
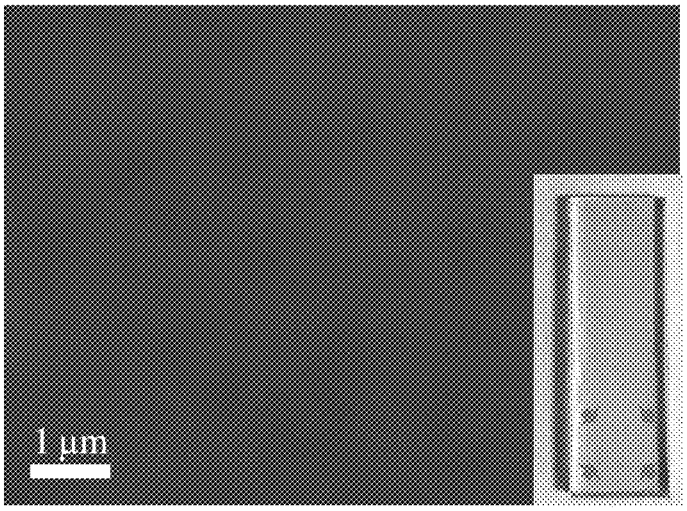
Figure 67:
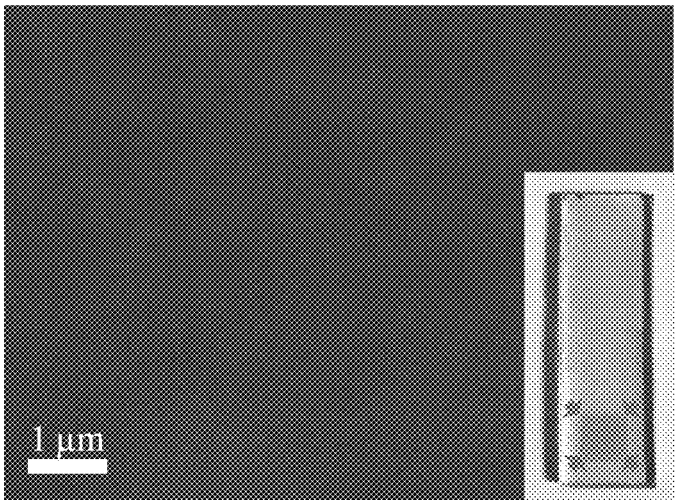
Figure 68:
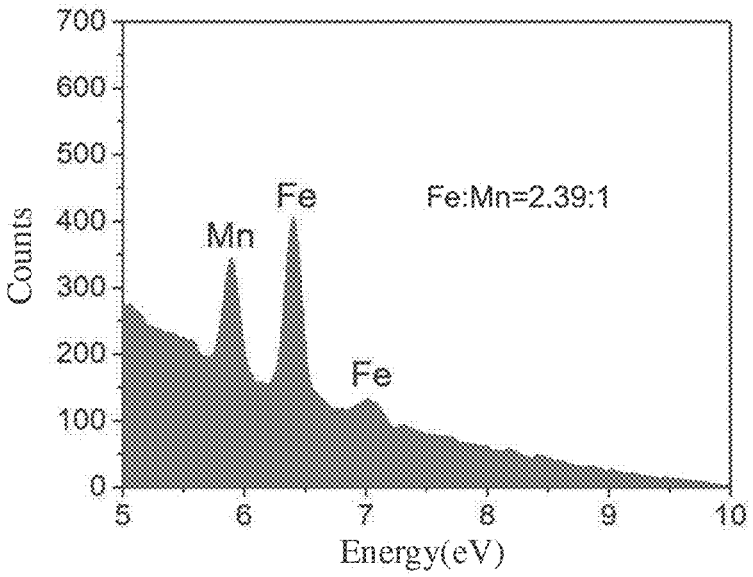
Figure 69:
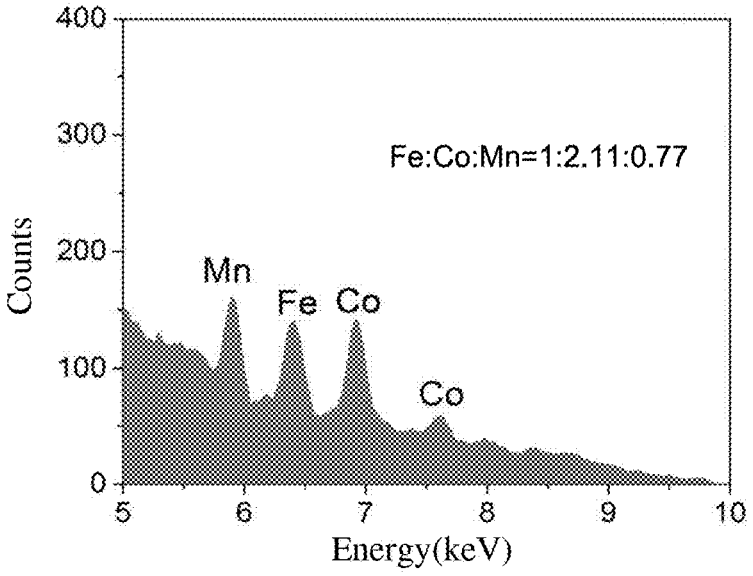

FIGS. 66-69 are schematic diagrams that illustrate characterization of amorphous iron manganese oxide and ternary iron cobalt manganese oxide coatings on $SiO_2$/Si wafers, wherein the SEM results reveal that both these two coatings (iron manganese oxides in FIG. 66 and iron cobalt manganese oxide in FIG. 67) are highly smooth and crack-free, their EDXS results are respectively shown in FIG. 68 and FIG. 69 giving the corresponding compositions of Fe:Mn=2.39:1 and Fe:Co:Mn=1:2.11:0.77, and insets in FIG. 66 and FIG. 67 shows the photographs of the film appearance on FTO.

Figure 70A:
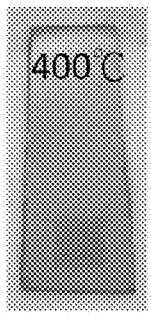
Figure 70B:
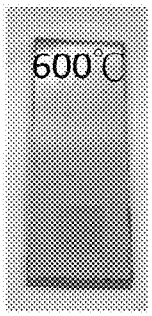
Figure 70C:
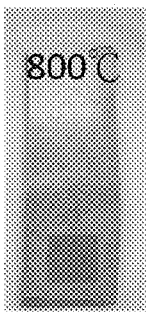

FIGS. 70*a*, 70*b*, and 70*c* are photographs showing samples resulting of a metal oxide calcined film at 400° C., 600° C., and 800° C., according to an embodiment of the present disclosure, respectively.

Figure 71A:
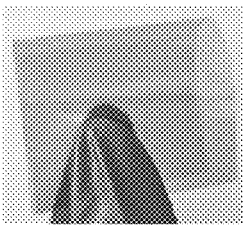
Figure 71B:
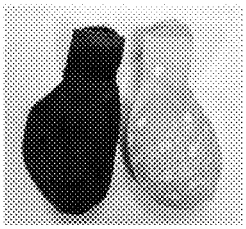

FIGS. 71*a* and 71*b* are photographs showing samples resulting of a sample of a substrate being different organic polymers, according to an embodiment of the present disclosure.

Figure 72A:
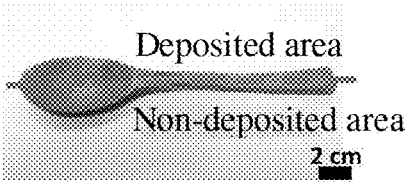
Figure 72B:
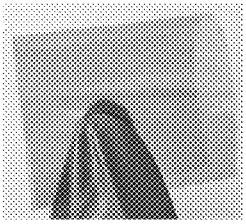
Figure 72C:
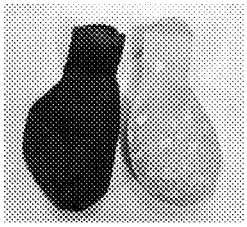

FIGS. 72*a* to 72*c* are photographs showing samples resulting of a sample of a substrate being different organic matters, according to an embodiment of the present disclosure.

Figure 73A:
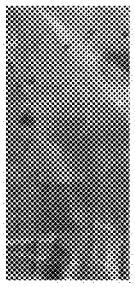
Figure 73B:
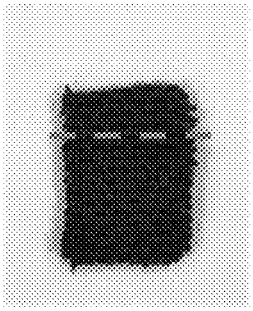
Figure 73C:
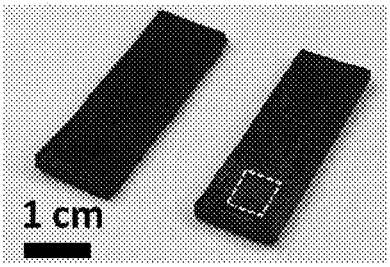

FIGS. 73*a* to 73*c* are photographs showing samples resulting of a sample of a substrate being different carbon materials, according to an embodiment of the present disclosure.

Figure 74:
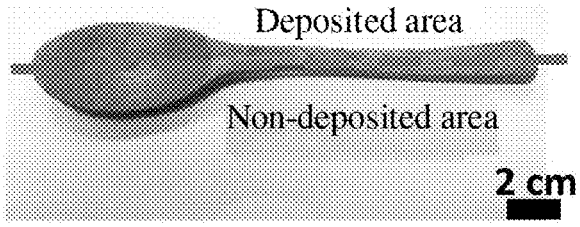

FIG. 74 is a photograph showing a sample resulting of a substrate being a carbohydrate, according to an embodiment of the present disclosure.

DETAILED DESCRIPTION OF THE INVENTION

The following description of the various embodiments is provided to illustrate the specific embodiments of the present disclosure. Furthermore, directional terms mentioned in the present disclosure, such as upper, lower, top, bottom, front, rear, left, right, inner, outer, side, surrounding, central, horizontal, lateral, vertical, longitudinal, axial, radial, uppermost or lowermost, etc., which only refer to the direction of drawings. Therefore, the directional terms used as above are for the purpose of illustration and understanding of the present disclosure, and are not intended to limit the present disclosure.

Herein, the term "film" indicates a thin layer covered on a surface. The thin layer has a set length, i.e., more than several nanometers, and has a uniform thickness, i.e., the thickness change is not more than 20% of the average thickness, which can be appreciated by a person having ordinary skill in the art. Detail description is not given to avoid redundancy.

Figure 1:
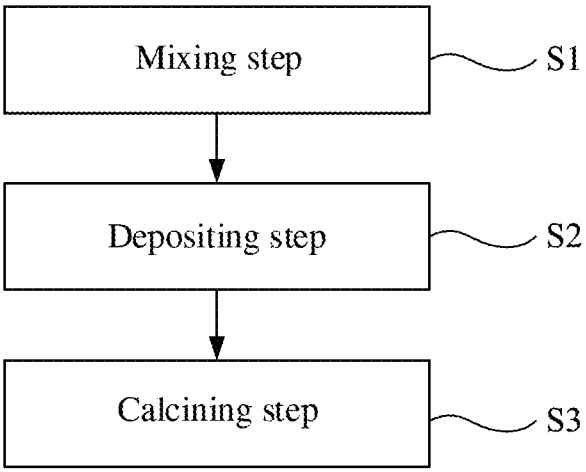
FIG. 1 depicts a flow chart demonstrating a method for manufacturing an amorphous multielement metal oxide hydroxide film according to an embodiment of the present invention.

Referring to FIG. 1, a method for manufacturing an amorphous multielement metal oxide hydroxide film according to an embodiment of the present invention can include a mixing step S1 and a depositing step S2.

Specifically, in the mixing step S1, a worker can dissolve an oxidizing agent and a reducing agent in a solvent, forming a liquid mixture. The oxidizing agent and the reducing agent can dissociate in the solvent and form an oxometallate anion and a metal cation, respectively. The oxometallate anion has a first atom, while the metal cation has a second metal atom.

The solvent is used to dissolve the oxidizing agent and the reducing agent, forming the oxometallate anion and the metal cation. As an example, the solvent can be water or other solvent that is able to form an intramolecular hydrogen bond with a water molecule, such as alcohol (e.g. methanol, ethanol) or ketone (e.g. acetone). Alternatively, the solvent can be a mixing solution of water and the above-mentioned other solvent. In the following, only water is taken as an example to illustrate the implementation in an aqueous environment. Preferably, the water can be, but not limited to, deionized water (DI water) with a resistivity of 18.2 MΩ-cm to promote the reaction quality.

The first metal atom of the oxometallate anion of the oxidizing agent has a first valence number. As an example, the oxidizing agent can be selected from a group consisting of potassium permanganate ($KMnO_4$), potassium chromate ($K_2CrO_4$), potassium dichromate ($K_2Cr_2O_7$) and potassium ferrate ($K_2FeO_4$). Take $KMnO_4$ as an example. $KMnO_4$ can dissociate in the solvent and form permanganate anion ($[MnO_4]^-$) having a manganese (Mn) atom. The first valence number of the Mn atom of the $[MnO_4]^-$ anion is 7+. Therefore, $KMnO_4$ can be used as the oxidizing agent that receives electrons from the second metal atom of the reducing agent, and the Mn atom can be reduced to have a second valence number. For better understanding, the oxidizing agents mentioned above are sorted as the following TABLE 1.

TABLE 1

| Oxidizing Agent | Oxometallate Anion | First Metal Atom | First Valence Number | Second Valence Number (After Being Reduced) |
|---|---|---|---|---|
| Potassium Permanganate ($KMnO_4$) | Permanganate Anion ($[MnO_4]^-$) | Manganese (Mn) Atom | 7+ | 4+ |
| Potassium Chromate ($K_2CrO_4$) | Chromate Anion ($[CrO_4]^{2-}$) | Chromium (Cr) Atom | 6+ | 3+ |
| Potassium Dichromate ($K_2Cr_2O_7$) | Dichromate Anion ($[Cr_eO_7]^{2-}$) | Chromium (Cr) Atom | 6+ | 3+ |
| Potassium Ferrate ($K_2FeO_4$) | Ferrate (IV) Oxyanion ($[FeO_4]^{4-}$) | Iron (Fe) Atom | 6+ | 3+ |

The reducing agent can be any metal salt including the metal cation, and the second metal atom of the metal cation has a third valence number. As an example, the second metal atom can be the main-group metal element (e.g., bismuth (Bi) atom, gallium (Ga) atom), metalloid element (e.g., germanium (Ge) atom), lanthanide series (e.g., cerium (Ce) atom) or transition metal element (e.g., cobalt (Co) atom, chromium (Cr) atom, iron (Fe) atom, palladium (Pd) atom, titanium (Ti) atom, vanadium (V) atom, nickel (Ni) atom, rhodium (Rh) atom, ruthenium (Ru) atom). The reducing agent including the metal cation can be an acetate, a sulfate, a nitrate, oxalate, a carbonate, or a halogen salt (e.g., a fluoride, a chloride, a bromide, an iodide). TABLE 2 exemplifies the reducing agents which are suitable for the present invention, as well as the second metal atom, the third valence number thereof, and the fourth valence number of the second metal atom after being oxidized.)

TABLE 2

| Classification | Second Metal Atom | Reducing Agent | Third Valence Number | Fourth Valence Number (After Being Oxidized) |
|---|---|---|---|---|
| Main-Group Metal Element | Bismuth (Bi) Atom | Bismuth(III) Acetate ($Bi(CH_3COO)_3$) | 3+ | 5+ |
| | Gallium (Ga) Atom | Gallium(II) Chloride ($GaCl_2$) | 2+ | 3+ |
| Metalloid Element | Germanium (Ge) Atom | Germanium(II) Iodide ($GeI_2$) Germanium(II) Bromide ($GeBr_2$) | 2+ | 4+ |
| Lanthanide Series | Cerium (Ce) Atom | Ammonium Cerium(III) Sulfate ($NH_4Ce(SO_4)_2$) Cerium(III) Sulfate ($Ce_2(SO_4)_3$) Cerium(III) Acetate ($Ce(CH_3COO)_3$) Cerium(III) Chloride ($CeCl_3$) Cerium(III) | 3+ | 4+ |

TABLE 2-continued

| Classification | Second Metal Atom | Reducing Agent | Third Valence Number | Fourth Valence Number (After Being Oxidized) |
|---|---|---|---|---|
| | | Nitrate ($Ce(NO_3)_3$) | | |
| Transition Metal Element | Cobalt (Co) Atom | Cobalt(II) Fluoride ($CoF_2$) | 2+ | 3+ |
| | | Cobalt(II) Acetate ($Co(CH_3COO)_2$) | | |
| | | Cobalt(II) Chloride ($CoCl_2$) | | |
| | | Cobalt(II) Bromide ($CoBr_2$) | | |
| | | Cobalt(II) Iodide ($CoI_2$) | | |
| | | Cobalt(II) Nitrate ($Co(NO_3)_2$) | | |
| | | Cobalt(II) Sulfate ($COSO_4$) | | |
| | Chromium (Cr) Atom | Chromium(II) Oxalate ($CrC_2O_4$) | 2+ | 3+ |
| | | Chromium(II) Acetate Hydrate ($Cr_2(CH_3COO)_4(H_2O)_2$) | | |
| | Iron (Fe) Atom | Iron(II) Bromide ($FeBr_2$) | 2+ | 3+ |
| | | Iron(II) Sulfate ($FeSO_4$) | | |
| | | Iron(II) Ammonium Sulfate ($(NH_4)_2Fe(SO_4)_2 \cdot 6H_2O$) | | |
| | | Iron(II) Acetate ($Fe(CH_3COO)_2$) | | |
| | | Iron(II) Chloride ($FeCl_2$) | | |
| | Nickel (Ni) Atom | Nickel(II) Sulfate ($NiSO_4$) | 2+ | 3+ |
| | | Nickel(II) Chloride ($NiCl_2$) | | |
| | | Nickel(II) Carbonate ($NiCO_3$) | | |
| | | Nickel(II) Nitrate ($Ni(NO_3)_2$) | | |
| | Lead (Pb) Atom | Lead(II) Nitrate ($Pb(NO_3)_2$) | 2+ | 4+ |
| | Palladium (Pd) Atom | Palladium(II) Sulfate ($PdSO_4$) | 2+ | 4+ |
| | Tin (Sn) Atom | Tin(II) Sulfate ($SnSO_4$) | 2+ | 4+ |
| | Titanium (Ti) Atom | Titanium(III) Chloride ($TiCl_3$) | 3+ | 4+ |

TABLE 2-continued

| Classification | Second Metal Atom | Reducing Agent | Third Valence Number | Fourth Valence Number (After Being Oxidized) |
|---|---|---|---|---|
| | Ruthenium (Ru) Atom | Ruthenium(III) Chloride ($RuCl_3$) | 3+ | 4+ |
| | | Ruthenium(III) Nitrate ($Ru(NO_3)_3$) | | |
| | Vanadium (V) Atom | Vanadium(II) Chloride ($VCl_2$) | 2+ | 5+ |
| | | Vanadium(III) Iodide ($VI_3$) | 3+ | |
| | | Vanadium(IV) Oxysulfate ($VOSO_4$) | 4+ | |
| | Rhodium (Rh) Atom | Rhodium(II) Acetate ($Rh_2(CH_3COO)_4$) | 2+ | 4+ |
| | | Rhodium(III) Nitrate ($Rh(NO_3)_3$) | 3+ | |
| | | Rhodium(III) Chloride ($RhCl_3$) | 3+ | |

Moreover, in the mixing step S1, a worker can mix the reducing agent and the oxidizing agent based on a molar ratio. As such, the reducing agent and the oxidizing agent can have the molar ratio in liquid mixture. In the embodiment, the molar ratio can range from 9:1 to 1:3.

Next, in depositing step S2, a worker can soak a substrate in the liquid mixture. As such, a multielement metal oxide hydroxide can be deposited on the substrate via a deposition reaction, forming the amorphous multielement metal oxide hydroxide film. The multielement metal oxide hydroxide deposited on the substrate has the first metal atom and the second metal atom. The first metal atom of the multielement metal oxide hydroxide has the second valence number smaller than the first valence number of the first metal atom of the oxometallate anion, while the second metal atom of the multielement metal oxide hydroxide has the fourth valence number larger than the third valence number of the second metal atom of the metal cation.

The substrate is not limited. However, in the embodiment, the substrate can be selected from a group consisting of silicon crystal, carbohydrate (e.g., biocellulose such as a wood shown in FIG. 74 or artificial leather), glass, nickel foam, metal, metal oxide, organic matter (e.g., a wood shown in FIG. 72*a*, a plastic plate shown in FIG. 72*b*, rubber balloons shown in FIG. 72*c*), organic polymer (e.g., a plastic plate shown in FIG. 71*a*, rubber balloons shown in FIG. 71*b*), carbon material (e.g., a graphene shown in FIG. 73*a*, a carbon cloth shown in FIG. 73*b*, a carbon/plastic composited substrate shown in FIG. 73*c*) and glassy carbon electrode. Moreover, the glass can further be selected from, but not limited to, a fluorine-doped tin oxide (FTO) conductive glass plate or an indium tin oxide (ITO) conductive glass plate.

Moreover, the deposition reaction can be carried out at a temperature ranging from 1° C. to 99° C. under an atmospheric environment. Preferably, the deposition reaction can be carried out at room temperature (a temperature ranging from about 20° C. to about 30° C.) under standard atmospheric pressure (a pressure of about 101,325 Pa). The deposition reaction can be carried out in a time period ranging from 5 minutes to 24 hours. However, a worker can indefinitely extend the time period according to demand.

It is worthy to note that depending on how many types of metals the manufactured amorphous multielement metal oxide hydroxide film includes, in the mixing step S1, a worker can form the liquid mixture by dissolving one or more oxidizing agents and one or more reducing agents in the solvent.

As an example, to manufacture an amorphous binary metal oxide hydroxide film including the Mn atom and the Co atom, a worker can use $KMnO_4$ as the oxidizing agent and use $Co(CH_3COO)_2$ as the reducing agent. The Mn atom and the Co atom can form the amorphous binary metal oxide hydroxide film following the chemical equation (2):

$$Mn^{7+} + 3Co^{2+} \rightarrow Mn^{4+} + 3Co^{3+}. \quad \text{chemical equation (2)}$$

To manufacture an amorphous binary metal oxide hydroxide film including the Fe atom and the Co atom, a worker can use $K_2FeO_4$ as the oxidizing agent and use $Co(CH_3COO)_2$ as the reducing agent. The Fe atom and the Co atom can form the amorphous binary metal oxide hydroxide film following the chemical equation (3):

$$Fe^{6+} + 3Co^{2+} \rightarrow Fe^{3+} + 3Co^{3+}. \quad \text{chemical equation (3)}$$

To manufacture an amorphous ternary metal oxide hydroxide film including the Mn atom, the Fe atom and the Ce atom, a worker can use $KMnO_4$ as the oxidizing agent and use $FeSO_4$, as well as $Ce(NO_3)_3$, as the reducing agents. The Mn atom, the Fe atom and the Ce atom can form the amorphous ternary metal oxide hydroxide film following the chemical equation (4):

$$Mn^{7+} + 1.5Fe^{2+} + 1.5Ce^{3+} \rightarrow Mn^{4+} + 1.5Fe^{3+} + 1.5Ce^{4+}. \quad \text{chemical equation (4)}$$

Moreover, to manufacture an amorphous ternary metal oxide hydroxide film including the Mn atom, the Fe atom and the Co atom, a worker can use $KMnO_4$ as the oxidizing agent, and use $FeSO_4$, as well as $Co(CH_3COO)_2$, as the reducing agents. The Mn atom, the Fe atom and the Co atom can form the amorphous ternary metal oxide hydroxide film following the chemical equation (5):

$$Mn^{7+} + 1.5Fe^{2+} + 1.5Co^{2+} \rightarrow Mn^{4+} + 1.5Fe^{3+} + 1.5Co^{3+}. \quad \text{chemical equation (5)}$$

Alternatively, a worker can further dissolve an additive in the solvent, and the additive dissociates in the solvent, forming an ion with a third metal atom. Notably, the third metal atom of the ion has a fifth valence number, and in the depositing step S2, the third metal atom of the multielement metal oxide hydroxide has a sixth valence number equal to the fifth valence number of the third metal atom of the ion. That is, the valence of the third metal does not change before and after the deposition reaction.

As an example, to improve the electric conductivity of the amorphous multielement metal oxide hydroxide film, the third metal atom that the additive includes can be the silver (Ag) atom, and the additive can be selected from silver nitrate ($AgNO_3$), silver(I) fluoride (AgF), silver(I) sulfate ($Ag_2SO_4$), etc. To improve the active area for catalysis of the amorphous multielement metal oxide hydroxide film, the third metal atom that the additive includes can be the aluminum (Al) atom, and the additive can be selected from aluminum nitrate ($Al(NO_3)_3$), aluminum cyanide ($Al(CN)_3$), aluminum(III) chloride ($AlCl_3$), etc. To improve the electric conductivity, as well as the electrocatalytic activity, of the amorphous multielement metal oxide hydroxide film, the third metal atom that the additive includes can be the gold (Au) atom, and the additive can be selected from chloroauric acid ($H[AuCl_4]$), etc. To improve the structural stability of the amorphous multielement metal oxide hydroxide film, the third metal atom that the additive includes can be the calcium (Ca) atom, and the additive can be selected from calcium chloride ($CaCl_2$), calcium nitrate ($Ca(NO_3)_2$), calcium iodide ($CaI_2$), etc. To improve the electric conductivity of the amorphous multielement metal oxide hydroxide film, the third metal atom that the additive includes can be the cadmium (Cd) atom, and the additive can be selected from cadmium chloride ($CdCl_2$), cadmium(II) sulfate ($CdSO_4$), cadmium nitrate(II) ($Cd(NO_3)_2$), etc. To improve the active metal amount per unit area of the amorphous multielement metal oxide hydroxide film, the third metal atom that the additive includes can be the strontium (Sr) atom, and the additive can be selected from strontium nitrate ($Sr(NO_3)_2$), strontium chloride ($SrCl_2$), strontium acetate ($Sr(CH_3COO)_2$), etc. To improve the active metal amount per unit area of the amorphous multielement metal oxide hydroxide film, the third metal atom that the additive includes can be the cesium (Cs) atom, and the additive can be selected from cesium sulfate ($Cs_2SO_4$), cesium nitrate ($CsNO_3$), cesium bromide (CsBr), cesium chloride (CsCl), cesium fluoride (CsF), etc. To improve the antimicrobial activity of the amorphous multielement metal oxide hydroxide film, the third metal atom that the additive includes can be the copper (Cu) atom, and the additive can be selected from copper(II) acetate ($Cu_2(CH_3COO)_4$), copper(II) nitrate ($Cu(NO_3)_2$), copper sulfate(II) ($CuSO_4$), copper(II) chloride ($CuCl_2$), etc. To improve the electrocatalytic activity of the amorphous multielement metal oxide hydroxide film, the third metal atom that the additive includes can be the iron (Fe) atom, and the additive can be selected from iron(III) chloride ($FeCl_3$), etc. To improve the structural stability of the amorphous multielement metal oxide hydroxide film, the third metal atom that the additive includes can be the magnesium (Mg) atom, and the additive can be selected from magnesium bromide ($MgBr_2$), magnesium nitrate ($Mg(NO_3)_2$), magnesium sulfate ($MgSO_4$), etc. To improve the electric conductivity of the amorphous multielement metal oxide hydroxide film, the third metal atom that the additive includes can be the platinum (Pt) atom, and the additive can be selected from platinum chloride ($PtCl_4$), chloroplatinic acid ($H_2PtCl_6 \cdot (H_2O)_6$), etc. To improve the active area for catalysis of the amorphous multielement metal oxide hydroxide film, the third metal atom that the additive includes can be the zinc (Zn) atom, and the additive can be selected from zinc chloride ($ZnCl_2$), zinc fluoride ($ZnF_2$), zinc sulfate ($ZnSO_4$), zinc nitrate ($Zn(NO_3)_2$), etc. To improve the electric conductivity of the amorphous multielement metal oxide hydroxide film, the third metal atom that the additive includes can be the scandium (Sc) atom, and the additive can be selected from scandium(III) sulfate ($Sc_2(SO_4)_3$), scandium(III) nitrate ($Sc(NO_3)_3$), scandium(III) bromide ($ScBr_3$), scandium(III) chloride ($ScCl_3$), scandium acetate ($Sc(CH_3COO)_3$), etc. To improve the photocatalytic activity of the amorphous multielement metal oxide hydroxide film, the third metal atom that the additive includes can be the gallium (Ga) atom, and the additive can be selected from gallium(III) nitrate ($Ga(NO_3)_3$), gallium(III) bromide ($GaBr_3$), gallium(III) chloride ($GaCl_3$), etc. To improve the photocatalytic activity of the amorphous multielement metal oxide hydroxide film, the third metal atom that the additive includes can be the germanium (Ge) atom, and the additive can be selected from germanium(IV) bromide ($GeBr_4$), etc. To improve the structural stability of the amorphous multielement metal oxide hydroxide film, the third metal atom that the additive includes can be the lithium (Li) atom, and the additive can be selected from lithium bromide (LiBr), lithium chloride (LiCl), lithium hydroxide (LiOH), etc. To improve the electric conductivity of the amorphous multielement metal oxide hydroxide film, the third metal atom that the additive includes can be the yttrium (Y) atom, and the additive can be selected from yttrium(III) nitrate ($Y(NO_3)_3$), yttrium(III) bromide ($YBr_3$), yttrium(III) chloride ($YCl_3$), etc. To improve the photocatalytic activity, as well as electrocatalytic activity for generating hydrogen gas, of the amorphous multielement metal oxide hydroxide film, the third metal atom that the additive includes can be the molybdenum (Mo) atom, and the additive can be selected from molybdenum(VI) oxide ($MoO_3$), etc. To improve the electric conductivity of the amorphous multielement metal oxide hydroxide film, the third metal atom that the additive includes can be the niobium (Nb) atom, and the additive can be selected from niobium(V) chloride ($NbCl_5$), etc. However, the additives applicable to the present invention are not limited to the previous mentioned example.

Moreover, referring to FIG. 1 again, after the depositing step S2, a calcining step S3 can be further carried out. In the calcining step S3, the amorphous multielement metal oxide hydroxide film is calcinated at a calcination temperature under a gas environment. As such, the multielement metal oxide hydroxide in the amorphous multielement metal oxide hydroxide film can phase transform, and a calcinated metal oxide film can be obtained. It is worthy to note that the calcination temperature ranges from phase transition temperature of the multielement metal oxide hydroxide and a physical limit temperature of the multielement metal oxide hydroxide. With such performance, the multielement metal oxide hydroxide in the amorphous multielement metal oxide hydroxide film can phase transform without destroying the amorphous multielement metal oxide hydroxide film. In the embodiment, the calcination temperature can range from 250° C. to 800° C. (for example, samples in FIGS. 70*a*, 70*b* and 70*c* are implemented at 400° C., 600° C., and 800° C., respectively.) Moreover, the gas environment can be an atmospheric environment, an argon environment, a nitrogen environment or an oxygen environment, while the time period for carrying out the calcining step S3 can range from 1 hour to 12 hours according to demand.

Some embodiments and test results of the above method embodiments of the present disclosure are further illustrated and described below, but that are not limited as described here.

To improve the intrinsic conductivity and reduce the charge transport barrier, achieving multicomponent metal oxide coatings with mixed valence and homogeneous distribution is a highly challenging, but effective strategy to enhance the electron hopping process and thus conductivities. Ultrathin, highly continuous deposition of amorphous multicomponent metal oxides is therefore an optimal and desirable model for OER electrocatalysts. As $KMnO_4$ is a strong stain reagent on various surfaces (e.g. fabrics, plastic, and even human skin), it is inspired to utilize this nature of $KMnO_4$ to achieve strong film adhesion on arbitrary substrates without pyrolysis treatment. $Co(OAc)_2$ and $KMnO_4$ interactions result in self-limited redox-coupled film growth governed by ligand coordination effects. For electrocatalytic OER applications, amorphous CMOH exhibits superior activities and durability to its crystalline counterpart and also benchmark $RuO_2$. Examples of the experimental part are presented as follows.

Preparation of CMOH Thin Films:

The reaction mixtures for deposition were prepared by dissolving cobalt precursors (i.e. $Co(OAc)_2$, $CoSO_4$, and $Co(NO_3)_2$) and $KMnO_4$ in deionized (DI) water (18.2 MΩ-cm) with a typical Co/Mn mole ratio of 3/1. As a substrate, we mainly used fluorine-doped tin oxide (FTO) glass obtained from Hartford Glass. FTO was rinsed with acetone, isopropyl alcohol (IPA), DI water, and 5.2 M $HNO_3$ under sonication for 10 minutes, followed by the exposure to $O_2$ plasma (25 W) for 20 seconds to complete the cleaning process. The deposition area is typically 0.5×0.5 $cm^2$, patterned by nail-polish oil masking. It also performed deposition on copper foil, Ni foam, carbon cloth, glassy carbon electrode (GCE), $SiO_2$/Si wafers, and glass. In a typical deposition, substrates were vertically placed in reaction mixtures of $KMnO_4$ and $Co(OAc)_2$ with 500 resale price maintenance (rpm) stirring at 80° C. for 15 minutes. The subscript of CMOH represents the anions of cobalt precursors used in the deposition. CMOH without specific subscript refers to $Co(OAc)_2$-deposition. After the deposition, the coatings were rinsed with DI water and the nail-polish mask was removed with acetone. The CMOH annealing was carried out at 500° C. for 1 hour under argon to obtain cobalt manganese oxide (CMO) films. The temperature-dependent CMOH deposition was carried out at room temperature, 50° C., 80° C., and 95° C.

Reaction mixtures with varied Co/Mn mole ratios were prepared (Co:Mn=1:3, 1:1, 3:1, 5:1, 7:1, and 9:1). For the redox deposition of iron manganese oxide coatings, $Fe(OAc)_2$ (Acros Organics) is used as the precursor with a Fe/Mn mole ratio of 3/1 in the reaction mixture. In the synthesis of ternary metal oxide films, $Co(OAc)_2$, $Fe(OAc)_2$, and $KMnO_4$ were mixed with a Fe/Co/Mn ratio of 1/2/1.

Electrochemical Measurements:

Electrochemical results were acquired using a three-electrode system on a CHI 614D Electrochemical Analyzer. FTO glass with CMOH coatings was used as the working electrode, where a Pt plate and Hg/HgO were used as the counter and reference electrodes, respectively. OER activities were evaluated by linear sweep voltammetry (LSV) with a scan rate of 5 mV $s^{-1}$ under 0.1 M KOH. All the overpotentials (η) were recorded at 10 mA $cm^{-2}$. The potentials presented herein are based on the reversible hydrogen electrode (RHE) following the equation (6):

$$E_{RHE}=E_{Hg/HgO}+0.098+0.059\times pH \quad \text{Equation (6).}$$

Faradaic efficiency (FE) was obtained using a gas chromatograph (GC) equipped with a thermal conductivity detector (TCD) to analyze the quantity of molecular oxygen. The FE was acquired from the ratio of $O_2$ measured/$O_2$ theoretical, where $O_2$ theoretical was integrated from the current-time (i-t) curve. A quartz crystal microbalance (QCM/CHI 401) was used to monitor the in situ growth of CMOH coatings at room temperature. The fundamental resonant frequency of QCM is 8 MHz. The weight change was calculated using the Sauerbrey equation (7):

$$\Delta f=-(2\times f_0^2\times\Delta m)/[A(\rho_a\times G_a)^{1/2}] \quad \text{Sauerbrey equation (7).}$$

where $f_0$ is the fundamental resonant frequency of QCM, $\rho_a$ is the density of quartz (2.648 g $cm^{-3}$), $G_a$ is the shear wave velocity of the quartz crystal ($2.947\times10^{11}$ g $cm^{-1}s^{-2}$), and A is the active electrode area of QCM. For all the QCM measurements, Au/quartz substrates were first kept in DI water until frequency equilibrium is reached. Afterwards, Co and Mn precursors were carefully injected into the system to initiate coating growth. Pure $Co(OAc)_2$ and $KMnO_4$ were also tested in QCM as control samples. To study the effect of counter ions, cobalt precursors with different anions of $Co(OAc)_2$, $CoSO_4$, and $Co(NO_3)_2$ were used following the same deposition conditions. Sodium acetate (Acros Organics) was used as the source of the acetate anion.

Characterization:

Scanning electron microscopy (SEM) images were obtained using a FEI Inspect F50 and Zeiss Supra 55 Gemini with acceleration voltages of 10-20 kV. The X-ray photoelectron spectroscopy (XPS) measurements were done on a PHI 5000 VersaProbe. The film composition profile was studied by Arsputtering XPS with a removal rate of 3 nm min-1. The grazing incident X-ray diffraction (GIXRD) was used to characterize CMOH thin coating with 1 degree (°) grazing angle on a Bruker D8 Advance diffractometer with a CuKα X-ray source. Field emission transmission electron microscopy (FE-TEM) images were collected with a FEI E.O Tecnai F20 G2 at 120 kV. TEM foils were prepared using a focused ion beam (FIB) using a SMI 3050. The CMOH/FTO samples were first coated with platinum and a subsequent carbon layer, followed by ion beam cutting and thinning. Samples were analyzed by energy dispersive X-ray spectroscopy (EDXS) under SEM and TEM. The Raman spectra were obtained using a WITec Confocal Raman Microscope with a 532 nm wavelength laser source. The CMOH samples were deposited on gold substrates to enhance the Raman signals via surface-enhanced Raman scattering. The X-ray absorption spectra (XAS) were collected at 17C1 in the National Synchrotron Radiation Research Center, Taiwan (NSRRC) with transmission mode. The roughness of CMOH films was analyzed by atomic force microscopy (AFM, Bruker Dimension Edge) with contact mode. The conductivity measurement was conducted using a four-point probe on a Quatek 5601Y Sheet Resistivity Meter. The UV-vis spectra were obtained with a Jasco V-630 UVvisible spectrometer. Inductively coupled plasma mass spectrometry (ICP-MS) measurements were carried out with a PerkinElmer ELAN 6100 DRC Plus for elemental analysis. To determine Co/Mn ratios, CMOH samples were dissolved in a solution composed of $HNO_3$ (60%) and $H_2O_2$ (35%) with a 2:1 volume ratio. To study the elemental leaching issue, the OER electrolyte solution (0.1 M KOH) after 10 000 cycle sweeps was sampled to determine the contents of Co and Mn.

Simulation of CMOH Deposition Behavior:

Molecular dynamics (MD) simulations were carried out to investigate the growth of the CMOH II lm on the FTO surface. The cases of $Co(OAc)_2$ and $CoSO_4$ deposition were investigated. The composition of the MD cell in the acetate system includes 1500 $Co^{2+}$, 3000 $OAc^-$, 500 $MnO_4^-$, 500 $K^+$, and 2000 $H_2O$ (solvent), while that of the sulfate system includes 1500 $Co^{2+}$, 1500 $SO_4^{2+}$, 500 $MnO_4^-$, 500 $K^+$, and 2000 $H_2O$. The crystalline tin oxide ($SnO_2$, 100×100×8 Å3) substrate was established to imitate FTO glass for the deposition. All simulations were computed by using Material Studio software. COMPASS force field and NVT ensemble were adapted for the simulations. The density of the liquid phase in each system was set to be 1.0 g $cm^{-3}$. The initial temperature of MD simulations was 298 K until a thermal equilibrium was reached; then the temperature was further increased to 353 K. This temperature setting corresponds to the real reaction temperature. The pair distances between $Co^{2+}$ and $Mn^{7+}$ (in $MnO_4^-$) to O on the $SnO_2$ surface, as well as $Co^{2+}$ to O in $MnO_4^-$ (i.e. $(MnO_4)$—Co complexes), were analyzed. The metal cation-to-O distances shorter than 3.0 Å were recognized to be due to the bond formation for yielding precipitate. This linking process was repeated five times for every 75 picoseconds. The following examples illustrate results and discussion.

Figure 2:
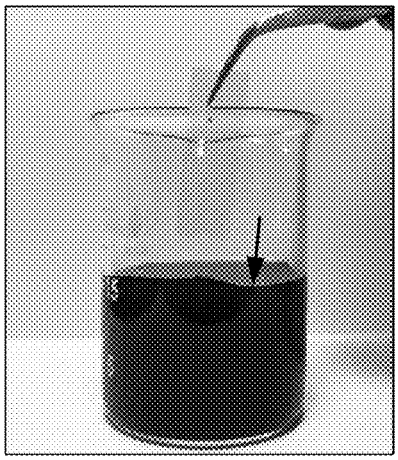
Figure 3:
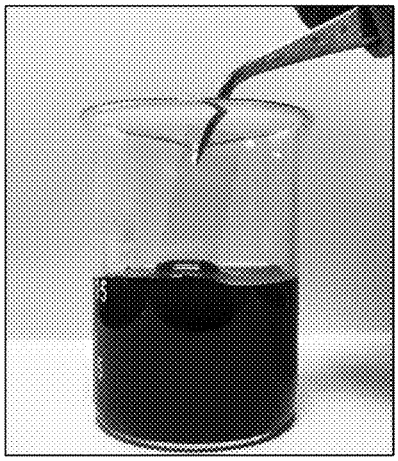
Figure 4:
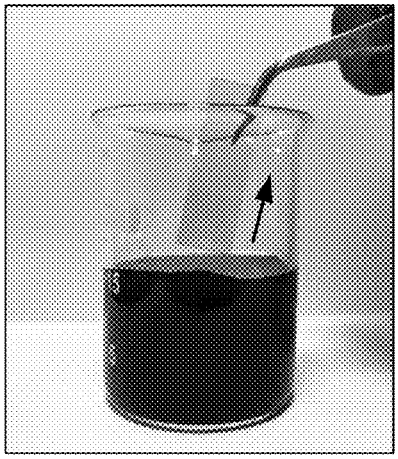
Figure 5:
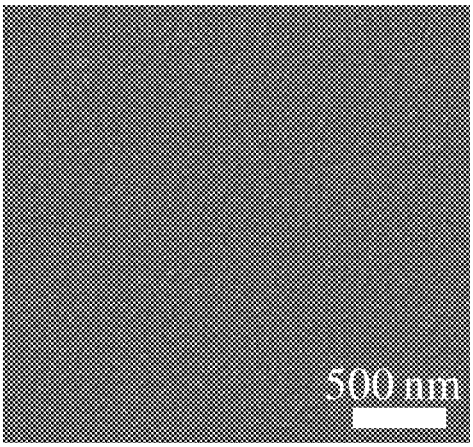

Deposition and Characterization of CMOH Coating:

The solution processed deposition of binary CMOH films was carried out in a single-step redox process under ambient conditions. The aqueous reaction mixtures were prepared by dissolving various Co(II) precursors with $KMnO_4$ (as the metal-containing oxidizing agent) without any additives (e.g. organic solvents, surfactants, polymers, etc.). To clearly demonstrate film deposition, transparent FTO was selected as the substrate as shown in FIGS. 2-10. The one-step CMOH deposition produced by the $Co(OAc)_2$ precursor (i.e. $CMOH_{acetate}$) can be accomplished by dipping pristine FTO in the reaction mixture, aging for a certain period of time, and removing it after complete deposition (FIGS. 2-4). Neither an inert atmosphere nor delicate operation was required. The uniformly dark contrast of deposition can be obtained with the homogeneous distribution of cobalt and manganese as proven by EDXS (FIGS. 48-51). The ICPMS analysis confirms the bulky composition of Co/Mn=2.92 (TABLE 3), similar to the selected-area composition of 3.08 acquired by EDXS.

TABLE 3

| | Deposition time (min) | | | | |
|---|---|---|---|---|---|
| | 1 | 5 | 15 | 30 | 60 |
| Co/Mn ratios of CMOH | 3.03 | 2.87 | 2.92 | 2.86 | 2.91 |
| | Co(II)-to-Mn(VII) precursor ratios | | | | |
| | 3:1 | 5:1 | 7:1 | 9:1 | |
| Co/Mn ratios of CMOH | 2.92 | 2.95 | 4.46 | 5.72 | |

Compared to other solution-based depositions, homogeneous binary elemental distribution generally requires specific reaction conditions due to potential mismatch in properties (e.g. hydrolysis rates, Ksp constants, thermal stabilities, etc.) between precursors. The fixed electron exchange stoichiometry dependent on the redox synthesis provides a reliable composition homogeneity for multi-precursor deposition. Different from typical dip-coating or polymer-assisted deposition, our procedure does not need thermal annealing to eliminate organic/polymer components and to consolidate coating adhesion, thus preserving the amorphous feature.

Figure 6:
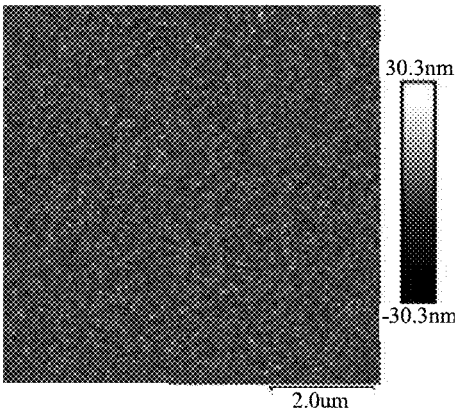
Figure 7:
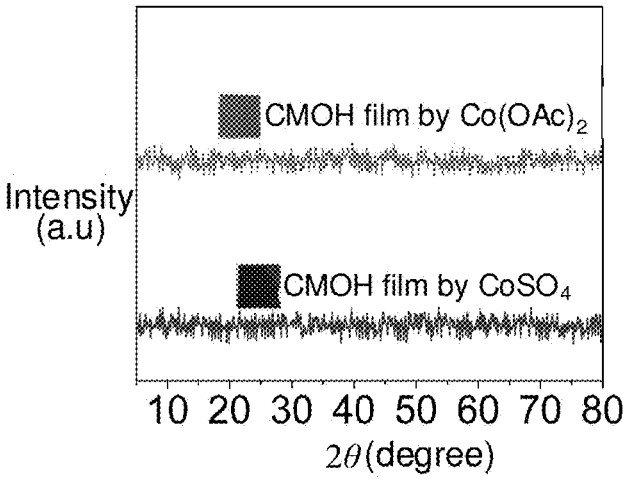

The SEM image (FIG. 5) of the CMOH film deposited on a $SiO_2$ wafer shows the smooth and highly continuous coating with a root-mean-square (RMS) value of 3.16 nm as acquired using AFM (FIG. 6). The GIXRD patterns of the samples deposited using $Co(OAc)_2$ and $CoSO_4$ precursors ($CMOH_{sulfate}$) show no diffraction peaks, indicating the amorphous features of CMOH coatings (FIG. 7). The Raman spectra of CMOHacetate exhibit a broad band at 599 $cm^{-1}$ (FIG. 52), which is also in agreement with the presence of amorphous cobalt oxide. The signals of amorphous manganese oxide are difficult to recognize due to their relatively small amounts (<25%), significant peak broadening, and similar Raman wavenumbers to cobalt oxide. By annealing $CMOH_{sulfate}$ at 500° C. for one hour, the coatings are shown to be crystalline corresponding to the spinel $Co_3O_4$ phase, denoted as cobalt manganese oxide ($CMO_{sulfate}$) (FIG. 53). To further verify the film crystallinity, the focused ion beam (FIB)-cut foils of $CMOH_{acetate}$ were characterized by high-resolution TEM. The TEM image of uncalcined $CMOH_{acetate}$ clearly shows amorphous features without any ordered lattice fringes (FIGS. 8 and 54), in agreement with the amorphous deposition shown in FIG. 7. The coating cross-section is highly continuous and pinhole/void-free with a major thickness of 6-10 nm, comparable with the thickness of 11 nm under AFM (FIG. 55). At this thickness, the reported coatings fabricated by physical deposition still remain discontinuous. The annealed $CMO_{acetate}$ films exhibit crystalline lattices with a d-spacing of 0.244 nm, corresponding to the (311) plane of spinel $Co_3O_4$ (FIG. 9). The film conductivities are summarized in TABLE 4, showing that CMOH coatings exhibit the sheet resistance in the range of $7.4\times10^7$ to $13.0\times10^7$ ($\Omega\square^{-1}$). The annealed CMO generally displays a smaller sheet resistance (as low as $0.469\times10^7$ $\Omega\square^{-1}$) than amorphous CMOH. $CMOH_{sulfate}$ is slightly more conductive than $CMOH_{acetate}$. Different Co/Mn ratios show insignificant influence on the film resistance. The controlled samples of manganese oxide coatings possess a sheet resistance that exceeds measurement limits, suggesting that homogeneous binary oxide coatings exhibit a much lower sheet resistance than single oxides.

TABLE 4

| | Sheet resistance($\Omega\square^{-1}$) × $10^7$ |
|---|---|
| $Co(OAc)_2$-precursor coating | |
| Co:Mn = 3:1 | 13.0 |
| Co:Mn = 7:1 | 11.5 |
| Co:Mn = 3:1 (annealed) | 10.6 |
| Co:Mn = 7:1 (annealed) | 8.95 |
| $CoSO_4$-precursor coating | |
| Co:Mn = 3:1 | 7.41 |
| Co:Mn = 7:1 | 7.40 |
| Co:Mn = 3:1 (annealed) | 0.470 |
| Co:Mn = 7:1 (annealed) | 0.649 |

Large Scale Fabrication and Properties of CMOH:

With the easy operation procedure, we attempted to achieve high throughput fabrication by parallel dipping of numerous substrates in one batch of the reaction mixture. FIGS. 11 and 12 show the success of parallel deposition to produce six individual, uniform and well-defined $CMOH_{acetate}$ coatings on FTO, more efficient than batch-to-batch deposition such as spin coating. In addition, shape- and size-specific deposition can be controlled by masking techniques. FIG. 13 shows the realization of large-scale arrays of square-shaped deposition over 10×10 $cm^2$ defined by the resin-based masks. All the patterned units of CMOH are well defined in shapes, interval distance, and show highly similar contrast. The scalable and throughput redox deposition appears highly practical for massive production.

Notably, the as-coated CMOH also exhibits high visible-light transparency. By changing the deposition temperatures (FIG. 14), the coating contrasts become darker as the temperature increases indicating the formation of a thicker coating. The transparency (at 550 nm) of CMOH deposited at room temperature, 50° C., 80° C., and 95° C. was measured to be 99.2%, 98.4%, 97.4%, and 95.2%, respectively (FIG. 15). Room-temperature CMOH forms a thin, uniform, and barely visible coating (see the arrows in FIG. 14). This property becomes relevant as binary metal oxides recently gained attention as materials for transparent OER-active thin films. Moreover, CMOH exhibits a higher transparency than the reported binary $FeNiO_x$ that is active for photoelectro-chemical cells (PEC) and sunlight-driven water splitting applications.

Film adhesion is a crucial concern particularly for low-temperature deposition. As shown in FIG. 16, we conducted peel-off tests with Scotch-tape on CMOH over 100 cycles. There were no appreciable film detachment or breaking observed. This strong adhesion is comparable to the annealed crystalline CMO samples, which allows CMOH to be directly used in the amorphous form. Moreover, referring to FIGS. 17 and 18, there were no appreciable film detachment or breaking observed in the amorphous binary metal oxide hydroxide film including the Fe atom and the Co atom.

The step coverage studies show that CMOH coating can be deposited along the top, side wall, and base of $SiO_2$ trenches with a similar thickness of 9.1 nm, 9.5 nm, and 10.1 nm, respectively (FIG. 19); hence, homogeneous CMOH deposition strongly attached on 3D complex architectures and porous tunnels can be expected. As shown in FIGS. **20*a*-20*f*, it is further successfully demonstrated CMOH deposition on complex 3D structures (Ni foam) and cylinder-shape substances (screw pairs). On different types of surfaces, including rigid glass, soft plastics (polyethylene terephthalate, PET), wood, and metal foils (Cu), CMOH deposition exhibits strong adhesion and high homogeneity (FIGS. 20*a*-20*f***). In particular, the coating on PET can completely tolerate the bending strain without appreciable film breaking after 100 cycle tests under 180 folding, agreeing with the excellent adhesion and mechanical properties.

Redox Interaction:

To verify the underlying principles of CMOH formation, oxidation states of cobalt and manganese are investigated. In the XPS spectra (FIG. 21), the binding energy of Co $2p_{1/2}$ at 796.2 eV, $2p_{3/2}$ at 781.1 eV, and the satellite peaks at 790.8 eV reveals the presence of Co(III). The XPS data also show that signals from Mn $2p_{3/2}$ and $2p_{1/2}$ are 641.8 and 654.2 eV, respectively, where $Mn^{3+}$ and $Me^{4+}$ are barely distinguishable (FIG. 22). In the spectra of O 1 s, the strong hydroxide signals can be observed at 532.0 eV and a weak signal of $O^{2-}$ at 530.0 eV (FIG. 23), showing similar ratios to metal oxyhydroxide species. After film annealing at 500° C., the hydroxide signals significantly decrease while $O^{2-}$ signals are much stronger due to the conversion of amorphous oxyhydroxide to crystalline oxide (FIGS. 56-58). Therefore, the presence of Co(III) and hydroxide/oxide signals indicates CoOOH-like amorphous CMOH. It is further conducted X-ray near edge structure studies of CMOH confirming the oxidation states of Co and Mn. The K-edge signals of Co (FIG. 24) are observed at 7728.6 eV, corresponding to the reported octahedral-coordinated Co(III) at 7729 eV, which further agrees with the XPS data. The Mn K-edge spectra (FIG. 25) show the peak at 6563 eV, nearly identical to that of $MnO_2$ at 6562.2 eV instead of Mn(III) at 6554.2 eV. The results, therefore, unambiguously confirm the presence of $Co^{3+}$ and $Mn^{4+}$ in CMOH coatings. As the elemental analysis highly agrees with ideal redox stoichiometry between $Co^{2+}$ and $Mn^{7+}$ as 3:1 (i.e. 2.86 to 3.03, see TABLE 3), it is evident that the redox-driven CMOH deposition can be expressed as $Co_{1-x}Mn_{3x/4}OOH$. Therefore the net redox equation (8) is shown as following:

$$9Co^{2+}_{(aq)} + 3MnO_4^-{}_{(aq)} + 14H_2O_{(l)} \rightarrow Co_9Mn_3O_{26}H_{13(s)} + 15H^+_{(aq)}. \quad \text{net redox equation (8)}$$

The film composition profiles of CMOH acquired by XPS (FIG. 26) exhibit uniform Co:Mn mole ratios (i.e. 3.30 by average) from top to bottom, corresponding well with the redox-coupled film growth as shown in equation (8). The depth profile studies show residue signals for sulfur and carbon to be less than 0.01%.

Coating Formation Process:

QCM is conducted to monitor the loading mass and film growth of CMOH on Au/quartz substrates in situ. First, it is conducted control experiments of deposition with the precursor either $Co(OAc)_2$ or $KMnO_4$ only. The profiles of FIG. 27 show no increase of mass loading in the $Co(OAc)_2$-only case, while the appreciable film formation can be observed in the $KMnO_4$-only case. In addition, the deposition tests on carbon-based and transparent substrates also show that only $KMnO_4$-deposition contributes to film formation (see FIGS. 59-60). This further confirms that the strong oxidative staining ability of $KMnO_4$ is critical for film formation and immobilization on substrates. For the tests combining $Co(OAc)_2$ and $KMnO_4$, the QCM profiles indicate a much faster and greater increase in mass loading than the previous two control experiments, verifying the redox-coupled nucleation.

As $Co^{2+}$ is the quantity-dominant species in the reaction mixture, attraction between the substrate-anchored $MnO_4$ anion and $Co^{2+}$ cation could facilitate on-site redox interaction on the substrate surface to form CMOH coating. Despite the reported studies of cobalt oxyhydroxide preparation via the redox route (e.g. interaction of $Co^{2+}$ and $S_2O_8^{2-}$ to yield CoOOH), their thin film deposition has been rarely recognized. Successful cobalt incorporation into the thin film form was first revealed in this work through redox interaction with $KMnO_4$. Theoretically, each $Mn^{7+}$ would transfer charge directly to three neighboring $Co^{2+}$ ions, giving the probability to construct interconnected networks holding multiple Co atoms with one Mn together through oxygen-bridged bonding. As a result, this network-like nucleation may favor the formation of continuous coating even at the ultrathin scale of several nanometers, rather than island-like, discontinuous deposition frequently observed in physical vapor deposition. Therefore, $KMnO_4$ is proposed to play the dual roles of both a surface-anchoring oxidizing agent and a cobalt-fixation reagent in the binary oxide deposition process.

Effect of the Precursor Anion on Deposition:

To investigate the control parameters of the film thickness, notably, it is observed that film growth was highly dependent on the counterions of cobalt precursors. Under identical conditions, as shown in FIG. 28, $CoSO_4$ and $Co(NO_3)_2$ precursors exhibit the general trend that the CMOH thickness is proportional to the deposition time. Their deposition rates (0.059 μg min.$^{-1}$ for CoSO4 and 0.086 mg min1 for $Co(NO_3)_2$) are 6 to 9 times faster than that for $Co(OAc)_2$ (0.0097 μg min.$^{-1}$). In fact, the $CoSO_4$ and $Co(NO_3)_2$ deposition can continuously go beyond several hours to generate a much thicker coating. On the other hand, the Co(OAc)2-deposition grew linearly at the first 50 minutes, and then became saturated at 60 minutes with the maximized loading mass of 2.97 μg cm$^{-2}$ (FIG. 28). This self-limiting phenomenon was also observed at different deposition temperatures of $CMOH_{acetate}$. The results clearly show that the deposition thicknesses produced vary depending on the precursor anions. As shown in FIG. 30, the cross-sectional SEM image of $CMOH_{sulfate}$ for 2 hours deposition, featured with the homogeneous elemental distribution for 180 nm thickness with the absence of cracks or pinholes/voids. Together with the ultrathin thickness of $CMOH_{acetate}$, the film thickness can be controlled ranging from several nanometers up to submicrons via precursor anions. To lower the interfacial barrier of electrocatalysis, $Co(OAc)_2$ deposition is adopted to produce ultrathin $CMOH_{acetate}$ for the later OER studies.

To further investigate the effect of anions, it is carried out the control experiments by adding acetate ions to $CoSO_4$-deposition (FIG. 29). The addition of two acetate ion equivalents, whose quantity is comparable to that of $Co(OAc)_2$, yielded a nearly identical saturation time and coating mass to that of $Co(OAc)_2^-$ deposition. However, the addition of one acetate ion equivalent, which corresponds to half of that in $Co(OAc)_2$, behaved similar to that of $CoSO_4$-deposition but no saturation was observed. In addition, the loading mass lies in between those of $CoSO_4$ and $Co(OAc)_2$ deposition. These phenomena clearly indicate that the self-limiting film growth is due to the presence of the acetate anion. It is also observed similar film growth inhibition with the identical anion combination of $Fe_2(SO_4)_3$ and $Ni(OAc)_2$ to this case. Indeed, acetate anions may act as a buffer species to influence the pH conditions and also the deposition. Their pH variation studies were partially effective but comprehensive understanding of the saturation growth of binary iron nickel oxides remained uncertain. Since the acetate anion possesses the stronger intrinsic coordination capability than the other two, it is most likely that the ligand coordination effect may rationalize the anion influence.

To verify the coordination effect, the hexadentate ligand of ethylenediaminetetraacetic acid (EDTA) is added as the much stronger coordination ligand than acetate for comparison. No coating formation can be observed in the presence of EDTA (FIG. 29), indicating that its ability to coordinate with $Co^{2+}$ significantly influences CMOH deposition. It is therefore compared the oxidation potentials of $EDTA^-$ and acetate-coordinated Co(II) under the deposition conditions. The $Co^{2+}/Co^{3+}$ oxidation potentials in the presence of acetate and sulfate anions are 1.55 and 1.63 V, respectively (see (I) and (V) in FIG. 31). With the addition of the acetate ligand to Co sulfate (mole ratio 2 to 1, see (II) and (III) in FIG. 31), the $Co^{2+}/Co^{3+}$ oxidation potentials decrease which is eventually similar to that of $Co(OAc)_2$. On the other hand, the addition of a stoichiometric amount of sodium sulfate to $Co(OAc)_2$ shows no significant change of $Co^{2+}$ oxidation peaks. By adding EDTA to $CoSO_4$, a drastic decrease in the $Co^{2+}/Co^{3+}$ oxidation potential to 0.67 V has been observed (see (IV) in FIG. 31). This oxidation potential drop for $Co^{2+}$ should make the redox deposition even easier and more spontaneous. But the observed absence of CMOH indicates that the ligand effect governs the deposition growth rather than the redox potential changes. The EDTA ligand traps $Co^{2+}$ tightly and may keep the coordinated $Co^{2+}$ away from the substrate for film growth. Compared to EDTA, the relatively labile and weak coordination of acetate may result in the suppressed deposition rather than a complete stop. It is also likely that the addition of coordination ligands may establish a new equilibrium unfavorable for the CMOH deposition. Thus, the precursor anion effect could be mainly attributed to the ligand coordination ability. As a result, the precise control of the thickness can be feasible through the proper selection of ligand additives.

Simulation Study of CMOH Growth:

FIGS. 32-35 shows the MD simulation studies of ($MnO_4$)—Co complexes that are yielded after the redox reaction in sulfate (see (a) in FIG. 32) and in acetate (see (b) in FIG. 32) deposition. The different gray-level dots represent O, Co, and Mn, respectively. Two different ($MnO_4$)—Co complexes, one forms in solutions as a colloidal precipitate (see (c) in FIG. 32) while the other binds with $SnO_2$ substrates (see (d) in FIG. 32) as film deposition, were depicted and studied. The quantity of colloidal complexes in sulfate solution was observed to be larger than that in acetate solution.

By correlating the numbers of ($MnO_4$)—Co colloidal complexes formed versus simulation time (FIG. 33), it is found that the formation rates in the sulfate solution are more than those in the acetate solution. The saturated number of ($MnO_4$)—Co colloidal complexes in acetate solution is found to be 480. Since the total number of Co ions is 1,500 at the initial stage, about one-third of Co ions in the acetate solution form the colloidal complexes. For ions in sulfate solution, the maximum number of colloidal complexes at the end of our simulation time is 780, that is, larger than one half of the number of Co ions.

Co ions are not only bonded to the oxygen in $MnO_4$, but also to the oxygen of the $SnO_2$ surface to form deposition (see (e) in FIG. 32 (sulfate system) and (f) in FIG. 32 (acetate system)). Similarly, the number of surface-linked complexes in sulfate solution was larger than that in acetate solution. Within the simulation time period, the number of surface-linked complexes in the acetate solution saturates but not in the sulfate case (FIG. 34). These simulation results agree well with the aforementioned experimental observation of ligand-governed CMOH deposition.

To further investigate the formation of the ($MnO_4$)—Co complex, we calculated the radial distribution function (RDF) of Co ions to O in sulfate (gCo—O(sulfate)) and O in acetate (gCo—O(acetate)). In FIG. 35, gCo—O(acetate) has a peak appearing around 3.5 Å, while gCo—O(sulfate) has no corresponding peak. This means that acetate anions closely surround Co ions with a high local density rather than being homogeneously dispersed in the whole solution cell. Such acetate-ion aggregation restricts the coordination of $Co^{2+}$ to other oxygen atoms (e.g. O of $SnO_2$ substrates), and may also accumulate a great negative charge barrier to repulse away the $MnO_4^-$ anion from facilitating redox interaction. The significantly inhibited CMOH deposition can also be explained to be due to change in ligands, from acetate to EDTA.

Electrocatalysis of the OER:

FIG. 36 shows a comparison of a linear sweep voltammogram (LSV) of amorphous $CMOH_{acetate}$ and crystalline $CMO_{acetate}$ deposited on FTO under 0.1 M KOH. No appreciable OER activities can be observed with bare FTO up to 1.9 V. The OER onset and over potentials ($\eta$ at 10 mA $cm^{-2}$) for amorphous CMOH are at 1.28 V and 390 mV, respectively. Crystalline CMO shows a higher onset potential than CMOH at 1.47 V with $\eta$ of 460 mV. At an over potential of 400 mV, the current density of CMOH is 11.60 mA $cm^{-2}$, which is 4.7 times greater than that of CMO. As compared to benchmark $RuO_2$, CMOH has the smaller onset potential of 180 mV and an overpotential of 200 mV. In FIG. 37, CMOH exhibits the favorable OER kinetics with a smaller Tafel slope of 60.9 mV $dec^{-1}$ than that of CMO (72.8 mV $dec^{-1}$). The faradaic efficiency of CMOH was measured to be nearly 100%, indicating that no side electrochemical reaction occurred during the OER (FIG. 61). In general, the greater conductivities enable the higher electrocatalytic performance. Amorphous CMOH, despite its lower conductivity, exhibits higher OER performance as compared to crystalline CMO (TABLE 4), clearly showing the intrinsic OER superiority of amorphous materials over crystalline ones. The comparison of OER performance with the reported thin coating is summarized in TABLE 6.

Metal oxyhydroxide (e.g. CoOOH, NiOOH) has been identified as the activity species for the OER. Thin amorphous metal oxyhydroxides are commonly obtained from the electrochemical conversion of metal hydroxides as precatalysts during the OER, rather than produced by direct deposition. Electrochemical conditioning is needed to transform crystalline metal hydroxides to oxyhydroxides for enhanced OER activity. It is found that no appreciable electrochemical conditioning was needed for CMOH to enhance OER performance (FIG. 36) since it may be already in the form of oxyhydroxide.

To investigate the optimal composition, the coatings with varied Co/Mn ratios have been produced by changing the precursor ratios in the initial reaction mixtures (See TABLE 3). By increasing the contents of cobalt precursors, the coatings are generally produced with greater Co/Mn ratios. Due to the redox interaction, the Co/Mn ratios of coatings are shown to be less varied (i.e. 2.92-5.72) compared to those of the reaction mixtures ranging from 3/1 to 9/1. The Co/Mn precursor ratio of 7/1 yielded the most active coatings ($CMOH_{7/1}$) with the smallest onset potential among the others (FIGS. 38, 62 and TABLE 5). The cobalt XPS data of $CMOH_{7/1}$ (FIG. 63) show a high similarity to those of $CMOH^{3/1}$, indicating that $Co^{3+}$ is still the main species of the coatings, instead of $Co^{2+}$. This might also suggest that $Co^{3+}$ is the active species responsible for the OER rather than Mn sites. Compared to the ideal redox stoichiometry and binary compositions, the relatively lower quantity of Mn in $CMOH_{7/1}$ may suggest $Mn^{4+}$ substitution by $Co^{3+}$ yielding cation vacancies in the framework of films due to charge compensation. These defects in small quantity could increase material conductivity and improve catalytic activities as those observed in $CMOH_{7/1}$ (see TABLE 4), but large contents of defects can weaken the structure stability. The significant drop of activities at Co/Mn=9/1 is thus attributed to the observed incomplete film formation due to even higher cation vacancies that collapse the framework of CMOH.

TABLE 5

| | Electrochemical performance | | |
|---|---|---|---|
| Sample | Onset potential (V) | Potential (V)@ 10 mA $cm^{-2}$ | Tafel slope (mV $dec^{-1}$) |
| Co:Mn = 1:3 | 1.50 | 1.73 | 64.0 |
| Co:Mn = 1:1 | 1.47 | 1.71 | 62.9 |
| Co:Mn = 3:1 | 1.43 | 1.68 | 62.0 |
| Co:Mn = 5:1 | 1.41 | 1.67 | 61.2 |
| Co:Mn = 7:1 | 1.28 | 1.62 | 60.9 |
| Co:Mn = 9:1 | 1.45 | 1.77 | 77.8 |
| CMO | 1.47 | 1.69 | 72.8 |
| $RuO_2$ | 1.42 | 1.82 | 73.6 |
| CMOH/Nickel foam | 1.23 | 1.54 | 80.1 |
| CMOH/Cu foil | 1.25 | 1.64 | 78.1 |
| CMOH/Carbon cloth | 1.36 | 1.57 | 68.9 |
| CMOH/GCE | 1.44 | 1.65 | 63.3 |

TABLE 6

| Sample | Onset potential(V) | Potential @10 mA $cm^{-2}$ | Electrolyte | Reference |
|---|---|---|---|---|
| CoPi | 1.64 | N/A | 0.1M KPi | 1 |
| $Ni_{0.9}Fe_{0.1}O_x$ | 1.53 | 1.57 | 1M KOH | 2 |
| $Mn_2O_3$ | N/A | 1.81 | 0.1M KOH | 3 |
| $FeCoNiO_x$ | 1.42 | N/A | 0.1M KOH | 4 |
| $Fe_{40}Co_{40}Ni_{20}O_x$ | 1.42 | N/A | 0.1M KOH | 5 |
| $Mn_2O_3$ | 1.40 | 1.67[a] | 1M KOH | 6 |
| Mn/Co—CB | 1.45 | N/A | 0.1M KOH | 7 |
| $CoO_x$—CoSe | 1.50 | N/A | 0.1M KOH | 8 |
| $Cu_3P$ | 1.60 | N/A | 0.1M KOH | 9 |
| CMOH | 1.28 | 1.62 | 0.1M KOH | Present Invention |

The OER stability tests of i-t curves (FIG. 39) were conducted at a current density of 10 mA $cm^{-2}$ for 60,000 seconds continuously. No appreciable drops (<2%) of current density for CMOH can be observed, while CMO shows the decrease of 18% of the current density. $RuO_2$ displays the more severe current density decrease of 67%, much larger than those of both CMOH and CMO. In addition, referring to FIGS. 40 and 41, even the test current density was increased to 5 A $cm^{-2}$, the current density for CMOH showed no significant change, indication the amorphous binary metal oxide hydroxide film including the Co atom and the Mn atom shows good binding ability with the substrate.

We compared cyclic LSV tests for 10,000 scans. Amorphous CMOH exhibits the nearly identical curves to the first run (FIG. 42), while crystalline CMO shows the current density decay of 16% with the increase of overpotential by 16 mV. Benchmark $RuO_2$ exhibits even greater current density decay of 18% and an increase of overpotential by 44 mV after the tests. In fact, both CMOH and CMO can be more stable than $RuO_2$ over the whole cycle tests. In the TEM characterization, the CMOH after the 10,000 cycle tests still remains amorphous without any crystalline features (FIG. 10), indicating that the exceptional oxygen evolution activities and stability were due to the amorphous characteristics despite the possible local structural rearrangement during the OER.

It is further conducted leaching studies by sampling the OER electrolyte solutions (0.1 M KOH) after 10,000 cycles. The ICP-MS data show that crystalline CMO coatings release both Co and Mn twice more than amorphous CMOH, which may explain the poor stability of CMO compared to CMOH over time (FIG. 39). The spinel phase has been recognized as an unfavorable structure to be transformed to oxyhydroxide. Well-crystalline spinel CMO with a rigid, ordered coordination environment may restrict the flexibility of structural alteration. The high lattice stress due to phase transformation increases the probability of irreversible bond breaking, leading to the observed Co and Mn leach. In contrast, the disordered amorphous CMOH is more structurally flexible to tolerate the greater degrees of structural rearrangement, including $Co^{3+/4+}$ exchange in OER mechanisms.

It has studied the thickness effect on the OER by varying deposition time and with different precursors of $Co(OAc)_2$ and $CoSO_4$. As shown in FIG. 43, under the same deposition time, the $Co(OAc)_2$-coatings generally exhibit better activities than $CoSO_4$-coatings. The nearly identical OER activities between 15 minutes and 60 minutes $Co(OAc)_2$-coatings consist of the observed self-limiting growth and negligible difference in thickness (also see FIGS. 64-65). For the case of $CoSO_4$-coatings, the longer deposition time results in the weaker OER performance closely associated with their drastic thickness difference. As ultrathin coating facilitates charge transport in electrocatalysis, the thickness control of CMOH through the ligand coordination effect can be a promising route to manipulate OER performance.

OER on Various Substrates:

With the substrate-universal deposition and easy operation, it is tested ultrathin CMOH on various substrates commonly used for the OER, including metal foils (Cu foils), carbon cloth, 3D Ni foams, and a glassy carbon electrode (GCE). As shown in FIGS. 44-47, the electrochemical results generally show the superior OER enhancement compared to the uncoated substrates, suggesting (1) the strong interfacial contacts between CMOH and the substrates for electrocatalysis, and (2) the exceptional OER activity of amorphous CMOH coatings. Notably, the LSV curve for bare Ni foam shows the oxidation peak at 1.34 V, corresponding to the transformation of Ni(II)/(III). However, the CMOH coating on Ni foam does not reflect the Ni(II)/(III) signal, but it exhibits an OER onset potential of 1.234 V which is very close to the theoretical one (1.23 V) together with a small overpotential of 0.31 mV. The improved OER performance has been summarized in TABLE 5. Under a 3 V electrolysis setup made by a series connection of two commercial batteries (1.5 V for each), the operation video clips show vigorous $O_2$ bubbling solely from the CMOH coated area rather than the uncoated ones. Compared to CMOH-coated electrodes, the commercial pristine carbon rods and Pt wires are relatively weaker in $O_2$ production under the same conditions. These results confirm that CMOH is responsible for the oxygen evolution with the superior OER activity to the substrates, including highly conductive and electrocatalytically active copper foils and Ni foam.

Ternary Oxide Film Deposition:

Following the deposition principle above, it is explored diverse film compositions by replacing $Co^{2+}$ with other transition metals, such as $Fe^{2+}$. The preliminary results show the success of iron manganese oxide coatings with a Fe/Mn ratio of 2.39, suggesting the feasibility of various metal oxide combinations through the redox protocol. Furthermore, with the presence of both $Co^{2+}$ and $Fe^{2+}$ with $KMnO_4$, the ternary iron-cobalt-manganese oxide coatings on FTO have been successfully produced, in which their component ratios are similar to the precursor ratios (Fe:Co:Mn=1:2.11:0.77, see FIGS. 64-69). The metal ion fixation role of $KMnO_4$ has been observed again for both $Co^{2+}$ and $Fe^{2+}$. According to previous work, metal-containing oxidizing agent KMnO4 in the redox synthesis can potentially be replaced by other oxometallates (i.e. $K_2Cr_2O_7$), not limited to $KMnO_4$ only. The realization of diverse combinations of multi-component amorphous coatings can be thus systematically studied via this redox protocol.

Accordingly, by the method for manufacturing the amorphous multielement metal oxide hydroxide film according to the present invention, the amorphous multielement metal oxide hydroxide film can be deposited on the substrate in the aqueous environment (i.e., the liquid mixture).

Moreover, the scalable, solution-processable protocols for multicomponent ultrathin metal oxide coatings capable of achieving pinhole-free, continuous, and substrate universal deposition. The redox-coupled film formation was proved critical for film growth, fixation, and homogeneous elemental distribution. As there is no more need for pyrolysis treatment, this protocol is a suitable alternative for amorphous deposition and substrates with low thermal durability.

CMOH thickness and compositions can be controlled by means of ligand selection. This protocol might be useful for the fabrication of wearable semiconductor devices, such as gate material deposition. For oxygen evolution, the new exploration of multicomponent amorphous metal oxides (e.g. more than four different metals) can be pursued for even greater durability and efficiency. The high transparency and film integrity by the redox protocol may open a new avenue for light-assisted PEC applications.

Notably, the above embodiments of the present disclosure are particularly related to an electroless deposition of a metal oxide film on various substrates (especially a plastic organic substrate, such as polyethylene terephthalate, polyurethane, polymethyl methacrylate, polyethylene naphthalate, or polycarbonate) in a liquid environment.

The method has at least the following advantages: the metal oxide hydroxide film and the metal oxide film are still continuous in an ultra-thin state, only the thickness a few nanometers such as 5 nm is required to form a film.

In addition, the metal oxide hydroxide film and the metal oxide film have high activity and stability in an oxygen evolution reaction.

In addition, the metal oxide hydroxide film and the metal oxide film have strong adhesion to FTO conductive glass, ITO conductive glass, silicon wafer, wood, glass, nickel foam, plastic, metal substrate, carbon material, glass carbon electrode, and have low interface resistance to a conductive substrate.

In addition, the metal oxide hydroxide film can be uniformly coated on a substrate with a complex structure because of the high permeability of the solution. The metal oxide hydroxide film can be manufactured without heating, and thus can be coated on a soft/non-heat resistant substrate due to low temperature and room pressure reflection conditions.

In addition, the metal oxide hydroxide film is produced with adding no surfactant, no vacuum environment, no valuable equipment, low cost, and low pollution.

In addition, the metal oxide hydroxide film and the metal oxide film have characteristics, such as uniformly distributed elements (redox electronic measurement), flat surface, uniform thickness and excellent stepping coverage efficiency (solution permeability).

In addition, the metal oxide hydroxide film and the metal oxide film have good transparency and uniform appearance.

In addition, the metal oxide hydroxide film has flexible property.

In addition, the metal oxide hydroxide film and the metal oxide film can be used for large-scale coating and pattern transfer reproduction.

In addition, the metal oxide hydroxide film and the metal oxide film can precisely be controlled to a ratio between constituent metals.

In addition, the metal oxide hydroxide film has a structure belonging to the amorphous form.

The present disclosure has been disclosed in its preferred embodiments, and it is not intended to limit the disclosure, and those skilled in the art can make various changes and modifications without departing from the spirit and scope of the disclosure. Therefore, the scope of protection of the present disclosure is subject to the definition of the scope of the appended claims.

What is claimed is:

1. A method for manufacturing an amorphous multielement metal oxide hydroxide film, comprising steps of:

(S1) dissolving an oxidizing agent and a reducing agent in a solvent to form a liquid mixture, wherein the oxidizing agent is selected from a group consisting of potassium permanganate ($KMnO_4$), potassium chromate ($K_2CrO_4$) and potassium dichromate ($K_2Cr_2O_7$), wherein the oxidizing agent dissociates in the solvent to form an oxometallate anion having a first metal atom, wherein the first metal atom of the oxometallate anion has a first valence number, wherein the reducing agent dissociates in the solvent to form a metal cation having a second metal atom, wherein the second metal atom of the metal cation has a third valence number; and (S2) depositing an amorphous multielement metal oxide hydroxide film on a substrate by soaking the substrate in the liquid mixture, wherein the amorphous multielement metal oxide hydroxide film comprises a multielement metal oxide hydroxide having the first metal atom and the second metal atom, wherein the first metal atom of the multielement metal oxide hydroxide has a second valence number smaller than the first valence number of the first metal atom of the oxometallate anion, wherein the second metal atom of the multielement metal oxide hydroxide has a fourth valence number larger than the third valence number of the second metal atom of the metal cation;

wherein the amorphous multielement metal oxide hydroxide film is a thin layer, with a uniform thickness of 6-10 nm, covered on a surface of the substrate;

wherein the multielement metal oxide hydroxide film has a homogeneous elemental distribution.

2. The method for manufacturing the amorphous multielement metal oxide hydroxide film as claimed in claim 1, wherein in the step (S1), a molar ratio between the reducing agent and the oxidizing agent in the liquid mixture ranges from 9-to-1 to 1-to-3.

3. The method for manufacturing the amorphous multielement metal oxide hydroxide film as claimed in claim 1, wherein in the step (S1), an additive is dissolved in the solvent to form an ion having a third metal atom, wherein the third metal atom of the ion has a fifth valence number, wherein in the step (S2), the multielement metal oxide hydroxide is a ternary metal oxide hydroxide, wherein the third metal atom of the ternary metal oxide hydroxide has a sixth valence number equal to the fifth valence number of the third metal atom of the ion.

4. The method for manufacturing the amorphous multielement metal oxide hydroxide film as claimed in claim 1, wherein in the step (S2), the amorphous multielement metal oxide hydroxide film is deposited at a temperature ranging from 1° C. to 99° C. under an atmospheric environment.

5. The method for manufacturing the amorphous multielement metal oxide hydroxide film as claimed in claim 4, wherein in the step (S2), the amorphous multielement metal oxide hydroxide film is deposited at room temperature under standard atmospheric pressure.

6. The method for manufacturing the amorphous multielement metal oxide hydroxide film as claimed in claim 1, wherein in the step (S2), the substrate is selected from a group consisting of silicon crystal, carbohydrate, glass, nickel foam, metal, metal oxide, organic matter, organic polymer, carbon material and glassy carbon electrode.

7. The method for manufacturing the amorphous multi-element metal oxide hydroxide film as claimed in claim 1, wherein in the step (S1), the solvent is deionized water with a resistivity of 18.2 MΩ-cm.

* * * * *